US007924253B2

(12) United States Patent
Huang et al.

(10) Patent No.: US 7,924,253 B2
(45) Date of Patent: Apr. 12, 2011

(54) LIQUID CRYSTAL DISPLAY

(75) Inventors: Hsueh-Ying Huang, Hsin-Chu (TW); Ming-Sheng Lai, Hsin-Chu (TW); Min-Feng Chiang, Hsin-Chu (TW)

(73) Assignee: Au Optronics Corporation, Hsin-Chu (TW)

( * ) Notice: Subject to any disclaimer, the term of this patent is extended or adjusted under 35 U.S.C. 154(b) by 829 days.

(21) Appl. No.: 11/872,993

(22) Filed: Oct. 16, 2007

(65) Prior Publication Data

US 2008/0165299 A1 Jul. 10, 2008

(30) Foreign Application Priority Data

Jan. 10, 2007 (TW) ..... 96100969 A

(51) Int. Cl.
*G09G 3/36* (2006.01)

(52) U.S. Cl. ..... 345/89; 345/690

(58) Field of Classification Search ..... 345/87–89, 345/92, 94, 95, 690
See application file for complete search history.

(56) References Cited

U.S. PATENT DOCUMENTS

| | | | |
|---|---|---|---|
| 5,151,805 | A | 9/1992 | Takeda et al. |
| 6,801,220 | B2 | 10/2004 | Greier et al. |
| 2002/0105489 | A1 | 8/2002 | Hashimoto et al. |
| 2003/0227429 | A1 | 12/2003 | Shimoshikiryo |
| 2005/0122441 | A1 | 6/2005 | Shimoshikiryoh |
| 2005/0213015 | A1 | 9/2005 | Shimoshikiryo |

*Primary Examiner* — Ricardo L Osorio
(74) *Attorney, Agent, or Firm* — Thomas, Kayden, Horstemeyer & Risley, LLP

(57) ABSTRACT

A liquid crystal display includes a plurality of pixels defined by adjacent scan lines and data lines. Each pixel includes a first sub-pixel defined by the scan line and a first common electrode line and a second sub-pixel defined by the scan line and a second common electrode line. The first common electrode line is connected to at least one of the voltage sources. The second common electrode is electrically connected to two of the voltage sources through a first and a second switch devices. The two switch devices are connected to different scan lines.

25 Claims, 20 Drawing Sheets

LIQUID CRYSTAL DISPLAY

RELATED APPLICATIONS

This application claims priority to Taiwan Patent Application Serial Number 96100969, filed Jan. 10, 2007, which is herein incorporated by reference.

FIELD OF THE INVENTION

The present invention relates to a liquid crystal display, and more particularly to a pixel structure for a liquid crystal display.

BACKGROUND OF THE INVENTION

Liquid crystal displays (LCDs) have been used in various electronic devices. A Vertically Aligned Mode (VA mode) LCD is developed to provide a wider viewing range. When a user looks at an LCD in the VA mode from an oblique direction, the skin color of Asian people (light orange or pink) appears bluish or whitish. Such a phenomenon is called color wash out.

A Multi-Domain Vertically Aligned Mode (MVA mode) LCD was developed by Fujitsu in 1997 to provide a wider viewing range. In the MVA mode, a 160 degree view angle and a high response speed was achieved. However, when a user looks at this LCD from an oblique direction, the skin color of Asian people (light orange or pink) appears bluish or whitish. Such a phenomenon is called color shift.

The transmittance-voltage (T-V) characteristic of the MVA mode liquid crystal display is shown in FIG. 1. The vertical axis is the transmittance rate. The horizontal axis is the applied voltage. When the applied voltage is increased, the transmittance rate curve 101 in the normal direction also increases. The transmittance changes monotonically as the applied voltage increases. In the oblique direction, the transmittance rate curve is the curve 102. However, in the region 100, when the applied voltage is increased, the transmittance rate curve 102 is not increased. That is the reason the color shifts.

A method is provided to improve the foregoing problem. According to the method, a pixel unit is divided into two sub pixels. The two sub pixels may generate two different T-V characteristics. By combining the two different T-V characteristics, a monotonic T-V characteristic can be realized. The line 201 in FIG. 2 shows the T-V characteristic of a sub-pixel. The line 202 in FIG. 2 shows the T-V characteristic of another sub-pixel. By combining the two different T-V characteristics of line 201 and line 202, a monotonic T-V characteristic can be realized, as shown by the line 203 in FIG. 2.

Therefore, a pixel unit is required to resolve the foregoing problems.

SUMMARY OF THE INVENTION

One object of the present invention is to provide a liquid crystal display that includes switch devices to adjust the voltage applied to the common electrode lines.

Another object of the present invention is to provide a liquid crystal display whose voltage applied to the common electrode lines may be adjusted to change the pixel voltage.

Still another object of the present invention is to provide a pixel unit that includes two sub-pixels with different pixel voltages, wherein each sub-pixel has different optical characteristics and compensates for the other sub-pixel to ease the color shift phenomenon.

Accordingly, the present invention provides a liquid crystal display comprising a plurality of data lines, a plurality of scan lines crossing the data lines, a plurality of first and second common electrode lines alternately arranged with the scan lines, a first switch device and a second switch device connected to different scan lines, and a plurality of voltage sources, wherein the first common electrode lines are connected to one of the voltage sources, and the second common electrode lines are connected to two of the voltage sources through the first switch device and the second switch device.

According to an embodiment of the present invention, the liquid crystal display further comprises a third switch device and a fourth switch device, wherein the first common electrode lines are connected to two of the voltage sources through the third switch device and the fourth switch device, and different scan lines control the third switch device and the fourth switch device.

According to an embodiment of the present invention, the voltage sources includes a first voltage source, a second voltage source and a third voltage source, wherein the first common electrode lines are connected to the third voltage source through the third switch device and connected to the first voltage source through the fourth switch device, and the second common electrode lines are connected to the third voltage source through the first switch device and connected to the second voltage source through the second switch device.

According to an embodiment of the present invention, wherein the voltage sources includes a first voltage source and a second voltage source, wherein the first common electrode lines are connected to the first voltage source, and the second common electrode lines are connected to the first voltage source through the first switch device and connected to the second voltage source through the second switch device.

According to an embodiment of the present invention, wherein the voltage sources includes a first voltage source, a second voltage source and a third voltage source, wherein the first common electrode lines are connected to the third voltage source, and the second common electrode lines are connected to the first voltage source through the first switch device and connected to the second voltage source through the second switch device The present invention provides a liquid crystal display comprising a plurality of data lines, a plurality of scan lines crossing the data lines, a plurality of first and second common electrode lines alternately arranged with the scan lines, a first switch device, a second switch device and a third switch device connected to different scan lines and a plurality of voltage sources, wherein the first common electrode lines are connected to one of the voltage sources, and the second common electrode lines are connected to two of the voltage sources through the first switch device, the second switch device and the third switch device.

According to an embodiment of the present invention, the liquid crystal display further comprises a fourth switch device, a fifth switch device and a sixth switch device, wherein the first common electrode lines are connected to two of the voltage sources through the fourth switch device, the fifth switch device and the sixth switch device.

Accordingly, a pixel unit in the present invention is divided into two sub-pixels. Each sub-pixel includes a thin film transistor, a liquid crystal capacitor and a storage capacitor. The two sub-pixels may generate different pixel voltages to compensate for the other sub-pixel to release the color shift phenomenon.

BRIEF DESCRIPTION OF THE DRAWINGS

The foregoing aspects and many of the attendant advantages of this invention are more readily appreciated and better understood by referencing the following detailed description, when taken in conjunction with the accompanying drawings, where.

DETAILED DESCRIPTION OF THE PREFERRED EMBODIMENT

In the present invention, a pixel unit is divided into two sub-pixels. The voltage supplied from the individual common electrode drives the pixel electrode of each sub-pixel. Therefore, two different pixel voltages are formed in a pixel unit.

Figure 1:
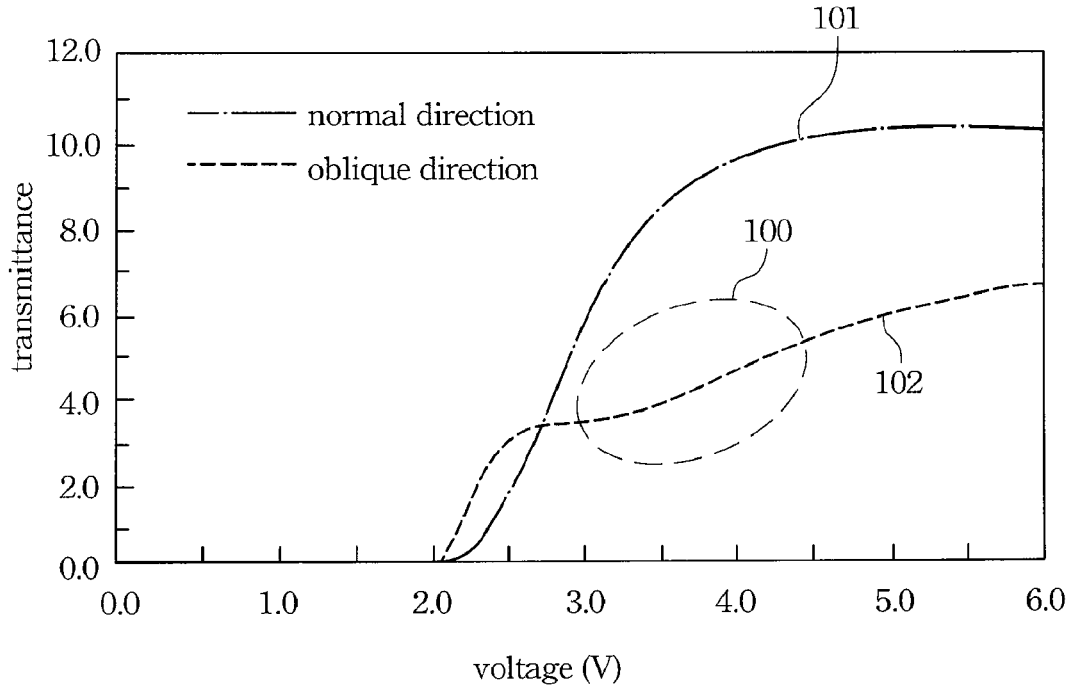
Fig. 1 (PRIOR ART)
FIG. 1 and FIG. 2 illustrate the transmittance-voltage (T-V) characteristic of MVA mode liquid crystal display.
Figure 2:
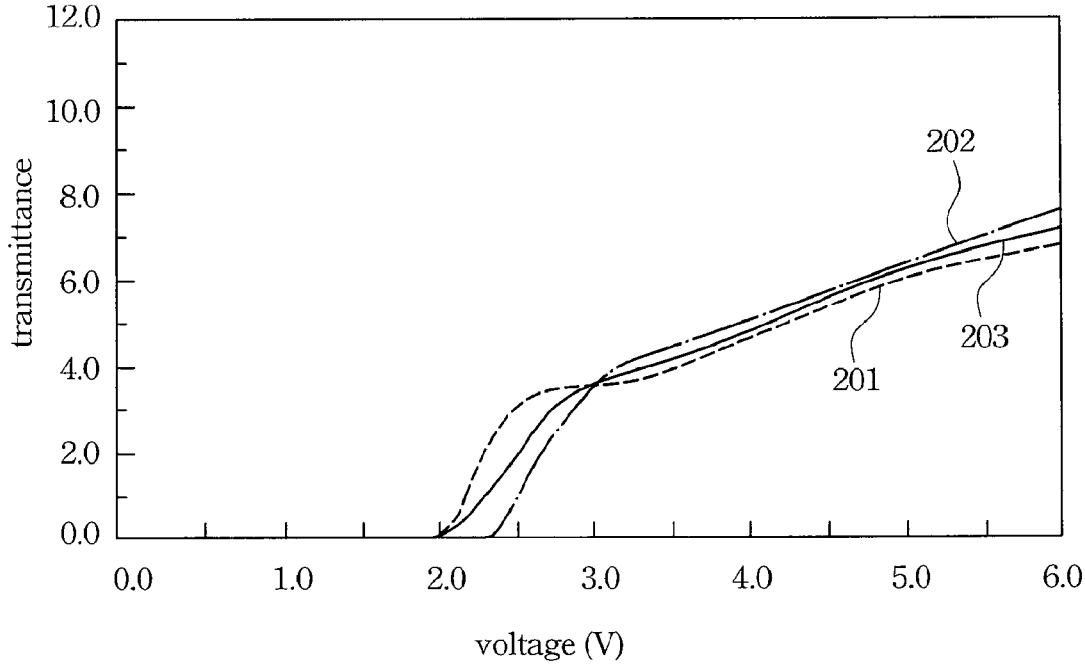
Fig. 2 (PRIOR ART)
Figure 3A:
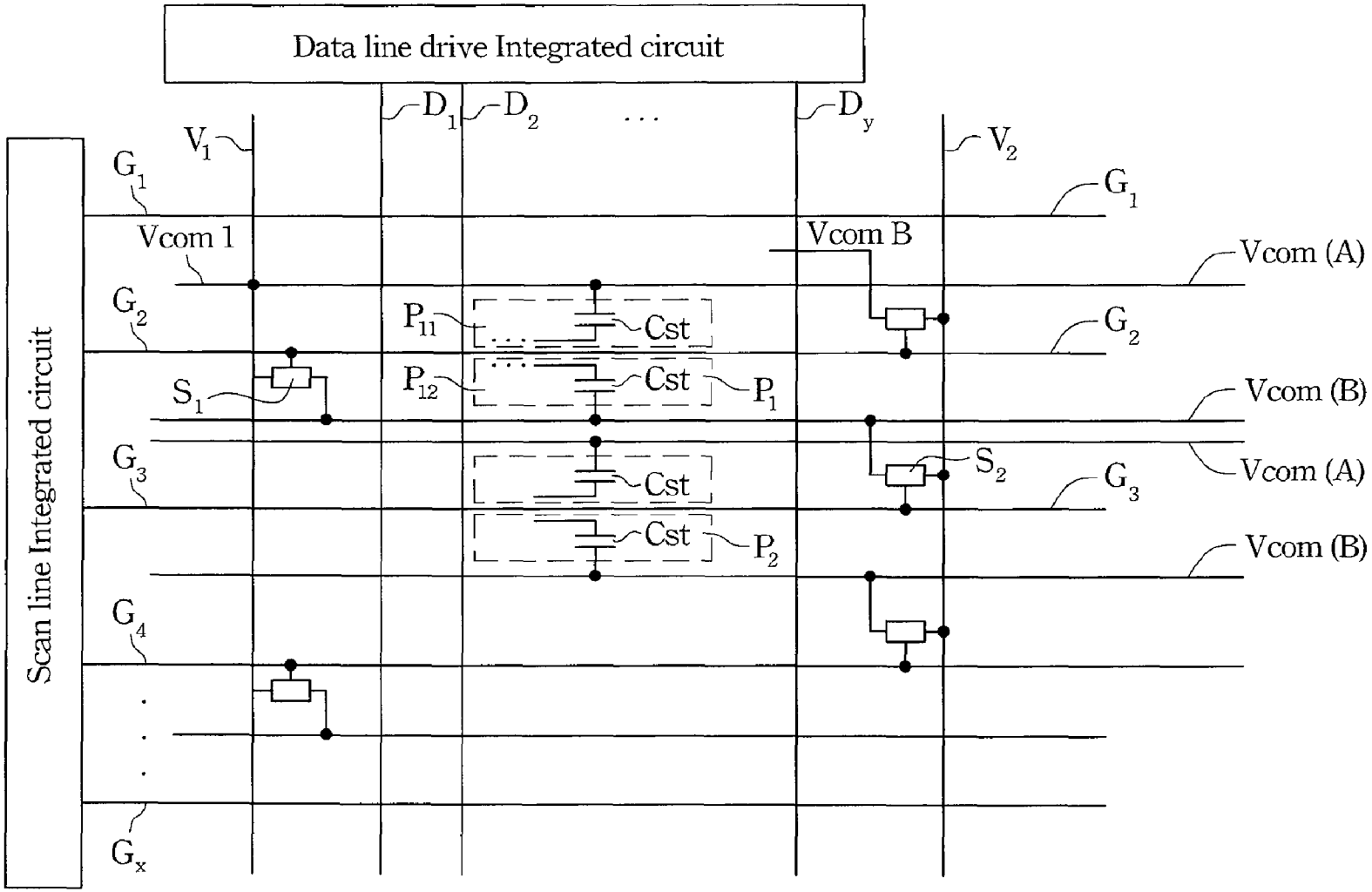
FIG. 3A illustrates a schematic diagram of a liquid crystal display according to the first embodiment of the present invention.

FIG. 3A illustrates a top view of a liquid crystal display according to the first embodiment of the present invention. The liquid crystal display is composed of data lines D1, D2, D3, . . . , Dy, scan lines G1, G2, G3, . . . , Gx and common electrode lines $V_{com}$(A) and $V_{com}$ (B). The data lines and the scan lines are perpendicular to each other. A data line driving integrated circuit controls the data lines D1, D2, D3, . . . , Dy. A scan line driving integrated circuit controls the scan lines G1, G2, G3, . . . , Gx. A pixel unit P1 is defined by adjacent data lines and adjacent scan lines. Two common electrode lines $V_{com}$(A) and $V_{com}$ (B) parallel to the scan lines are arranged in the pixel unit.

According to the first embodiment of the present invention, the pixel unit P1 is divided into two sub-pixels P11 and P12. Each sub pixel P11 or P12 includes a storage capacitor $C_{st}$ that is composed of the pixel electrode and the common electrode. The storage capacitors located in different sub pixels P11 and P12 are connected to different common electrodes. The voltages applied to the common electrodes are tuned to change the voltage in the pixel electrodes in the sub pixels P11 and P12 respectively. In this embodiment, the common electrode line $V_{com}$ (B) is connected to the voltage sources V1 and V2 through two switch devices S1 and S2 respectively. Therefore, a two-step drive waveform is applied to the common electrode line $V_{com}$ (B). The scan lines G2 and G3 respectively control the switch of the switch devices S1 and S2. The common electrode line $V_{com}$ (A) is only connected to the voltage source V1. Therefore, a fixed voltage V1 is applied to the common electrode line $V_{com}$ (A).

Figure 3B:
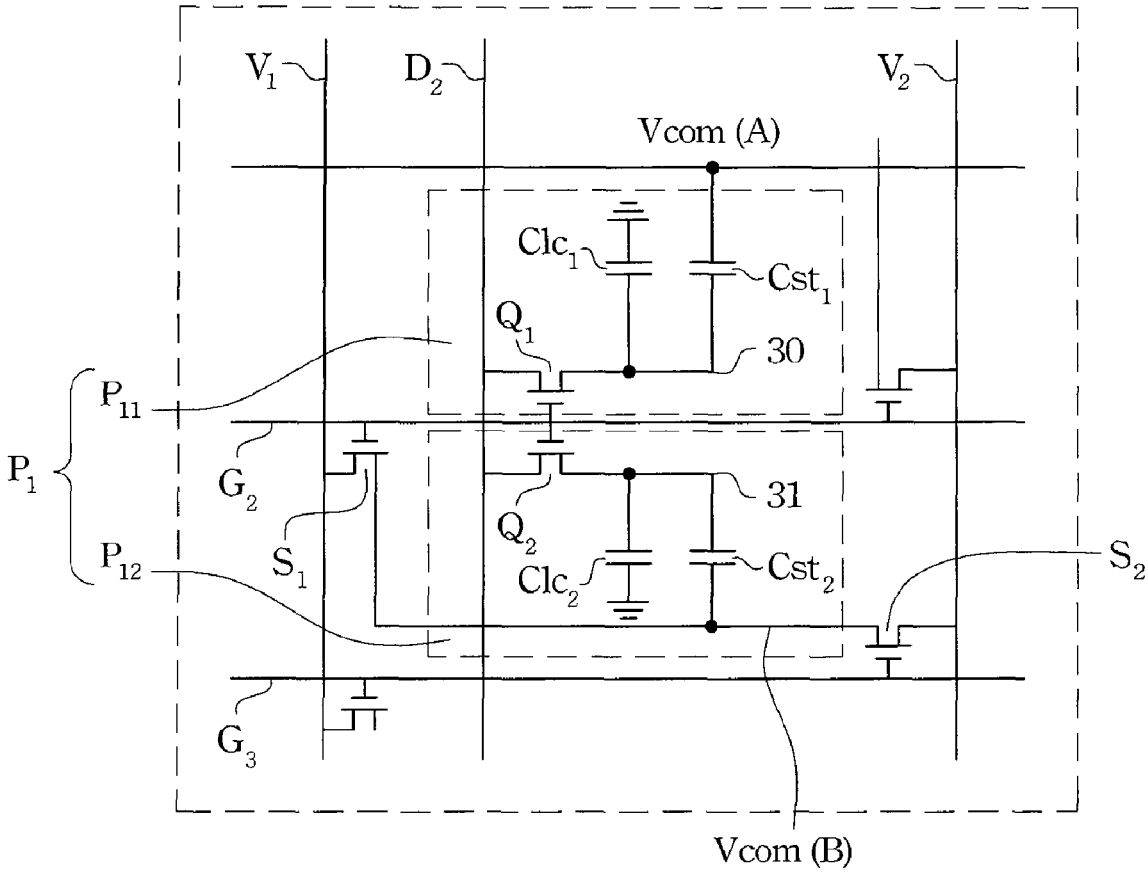
FIG. 3B illustrates an enlarged schematic diagram of a pixel unit according to the first embodiment of the present invention.

FIG. 3B illustrates an enlarged diagram of a pixel unit P1. The pixel unit P1 is defined by the data line D2 and the scan line G2. Two common electrode lines $V_{com}$(A) and $V_{com}$ (B) parallel to the scan line G2 are arranged on both sides of the scan line G2. The pixel unit P1 is divided into two sub-pixels P11 and P12. The sub-pixel P11 is located between the scan line G2 and the common electrode $V_{com}$ (A). The sub pixel P12 is located between the scan line G2 and the common electrode $V_{com}$ (B).

The sub-pixel P11 includes a transistor $Q_1$. According to the transistor $Q_1$, the gate electrode is connected to the scan line G2, the first source/drain electrode is connected to the data line D2 and the second source/drain electrode is connected to the pixel electrode 30. The storage capacitor $C_{st1}$ is composed of the pixel electrode 30 and the common electrode $V_{com}$(A). The liquid crystal capacitor $C_{LC1}$ is composed of the pixel electrode 30 and the conductive electrode in the upper substrate (not shown in figure).

The sub-pixel P12 also includes a transistor $Q_2$. According to the transistor $Q_2$, the gate electrode is connected to the scan line G2, the first source/drain electrode is connected to the data line D2 and the second source/drain electrode is connected to the pixel electrode 31. The storage capacitor $C_{st2}$ is composed of the pixel electrode 31 and the common electrode $V_{com}$(B). The liquid crystal capacitor $C_{LC2}$ is composed of the pixel electrode 31 and the conductive electrode in the upper substrate (not shown in figure).

The transistors $Q_1$ and $Q_2$ act as switches to control the sub-pixel P11 and the sub-pixel P12 respectively. When a scan voltage is applied to the scan line G2, the transistors $Q_1$ and $Q_2$ are turned on. The data voltage in the data line D2 is transferred to the pixel electrode 301 and the pixel electrode 31 and is written into the corresponding storage capacitor $C_{st1}$, the storage capacitor $C_{st2}$, the liquid crystal capacitor $C_{LC1}$ and the liquid crystal capacitor $C_{LC2}$.

In this embodiment, the common electrode line $V_{com}$ (A) is connected to the voltage source V1. The common electrode line $V_{com}$ (B) is connected to the voltage source V1 through the switch device S1 and connected to the voltage source V2 through the switch device S2. The scan line G2 controls the switch of the switch device S1 is controlled. The scan line G3 controls the switch device's switch. In a frame time, the scan lines G2 and G3 are sequentially driven. The voltage source V1 and the voltage source V2 sequentially-supply voltage to the common electrode line $V_{com}$ (B). Therefore, a two-step drive waveform is generated in the common electrode line $V_{com}$ (B). According to the present invention, the scan lines G2 and G3 are sequentially driven to respectively turn on the switch device S1 and S2 to change the voltage source connected to the common electrode line $V_{com}$ (B). By the coupling effect of the storage capacitor $C_{st2}$, different voltages are applied to the pixel electrode 31 to make the two sub-pixels P11 and P12 have different pixel voltages.

Figure 3C:
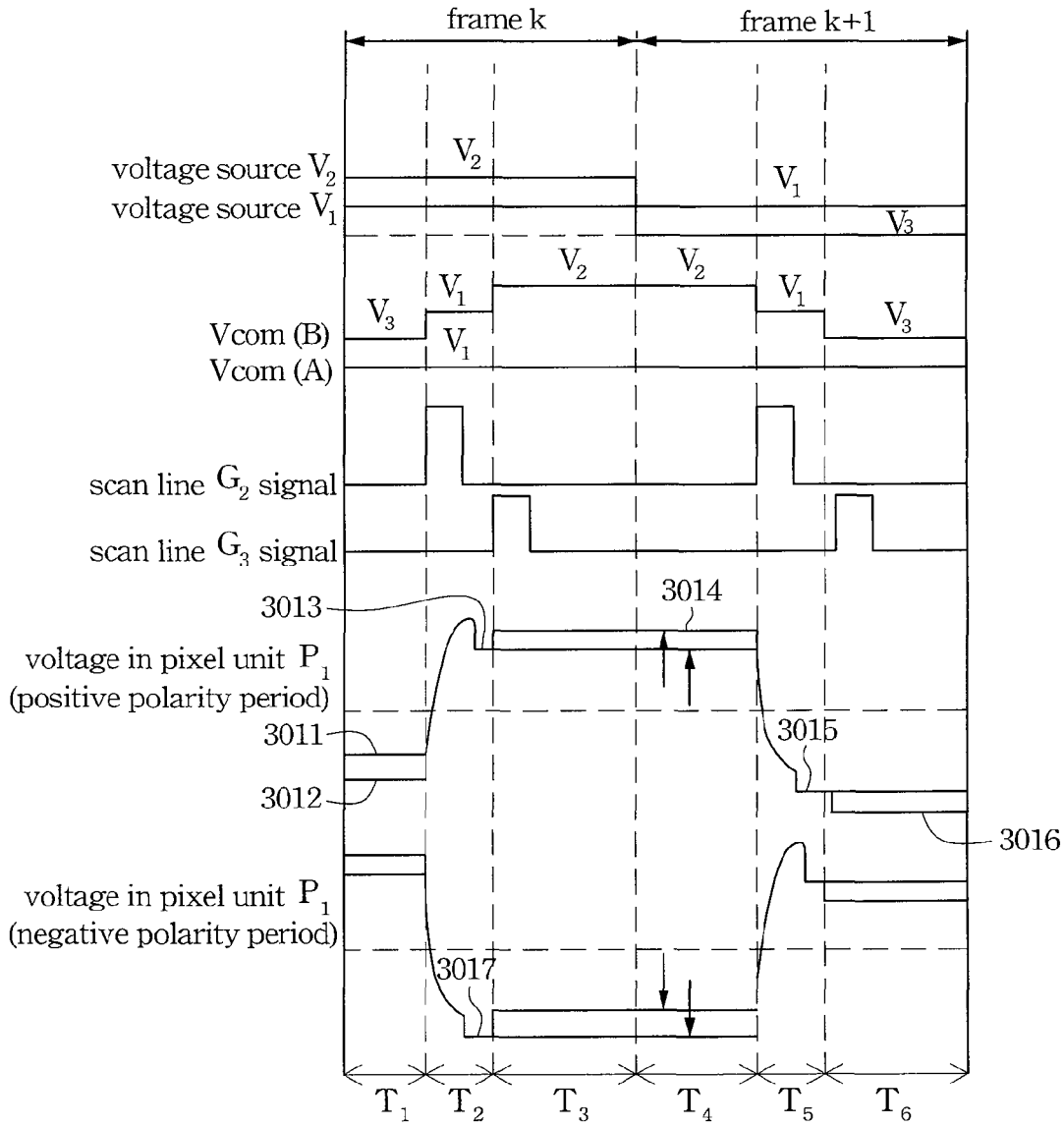
FIG. 3C illustrates drive waveforms for the common electrodes according to the first embodiment of the present invention.

FIG. 3C illustrates a drive waveform for driving a liquid crystal display according to the first embodiment of the present invention. With reference to FIG. 3B and FIG. 3C, during the time segment $t_1$ in frame K, the scan line G2 is in a low voltage state. Therefore, the transistors $Q_1$ and $Q_2$ and the switch devices S1 and S2 are turned off. The common electrode line $V_{com}$ (A) is connected to the voltage source V1. Therefore, a voltage V1 is applied to the common electrode line $V_{com}$ (A). Therefore, the voltage states in the liquid crystal capacitors $C_{LC1}$ and $C_{LC1}$ and the voltage states in the storage capacitors $C_{st1}$ and $C_{st2}$ are same as that in the previous time segment. In this case, the pixel electrode 30 in the sub-pixel P11 has the pixel voltage 3011 and the pixel electrode 31 in the sub-pixel P12 has the pixel voltage 3012.

During the time segment $t_2$ in frame K, the scan line G2 is in a high voltage state. Therefore, the transistors $Q_1$ and $Q_2$ and the switch device S1 are turned on. The common electrode line $V_{com}$ (A) is connected to the voltage source V1. Therefore, a voltage V1 is applied to the common electrode line $V_{com}$ (A). The common electrode line $V_{com}$ (B) is connected to the voltage source V1 through the switch device S1. Therefore, a voltage V1 is also applied to the common electrode line $V_{com}$ (B). That is the common electrode line $V_{com}$ (A) and the common electrode line $V_{com}$ (B) have the same voltage. The voltage in the data line $D_2$ may charge the liquid crystal capacitors $C_{LC1}$ and $C_{LC1}$ and the storage capacitors $C_{st1}$ and $C_{st2}$ through the transistors $Q_1$ and $Q_2$. At this time, the pixel electrode 30 and the pixel electrode 31 in the sub-pixel P11 and P12 have the pixel voltage 3013 in the data line $D_2$.

During the time segment $t_3$ in frame K, the scan line G3 is scanned. Therefore, the scan line G3 is in a high voltage state and the scan line G2 is in a low voltage state. The transistors $Q_1$ and $Q_2$ and the switch device S1 are turned off. The switch device S2 is turned on. The common electrode line $V_{com}$ (A) is connected to the voltage source V1. Therefore, a voltage V1 is applied to the common electrode line $V_{com}$ (A). The common electrode line $V_{com}$ (B) is connected to the voltage source V2 through the switch device S2. Therefore, a voltage V2 is applied to the common electrode line $V_{com}$ (B). At the start of time segment $t_3$, the pixel electrode 30 and the pixel electrode 31 have the pixel voltage 3013 in the data line $D_2$. However, at the start of the time segment $t_3$, the voltage applied to the common electrode $V_{com}$(B) in the sub-pixel P12 changes from V1 to V2 volts. Such a voltage change may change the voltage in the pixel electrode 31 from voltage 3013 up to the voltage 3014 through the coupling effect of the storage capacitor $C_{st2}$. On the other hand, the voltage applied to the common electrode $V_{com}$(A) in the sub-pixel P11 keeps the voltage V1. Therefore, the voltage in the pixel electrode 30 keeps the voltage 3013. Therefore, the pixel electrode 30 and the pixel electrode 31 in the sub-pixel P11 and P12 have different voltages.

Next, during the time segment $t_4$ in frame K+1, the scan lines are scanned again. The scan line G2 is not scanned. Therefore, the scan line G2 is in a low voltage state. Therefore, the transistors $Q_1$ and $Q_2$ and the switch devices S1 and S2 are turned off. The common electrode line $V_{com}$ (A) is connected to the voltage source V1. Therefore, a voltage V1 is applied to the common electrode line $V_{com}$ (A). The common electrode line $V_{com}$ (B) keeps the voltage V2 due to the storage capacitors $C_{st1}$. Therefore, the voltage states in the liquid crystal capacitors $C_{LC1}$ and $C_{LC1}$ and the voltage states in the storage capacitors $C_{st1}$ and $C_{st2}$ are same as that in the previous time segment $t_3$. In this case, the pixel electrode 30 in the sub-pixel P11 has the pixel voltage 3013 and the pixel electrode 31 in the sub-pixel P12 has the pixel voltage 3014.

During the time segment $t_5$ in frame K+1, the scan line G2 is scanned. Therefore, the scan line G2 is in a high voltage state. Therefore, the transistors $Q_1$ and $Q_2$ and the switch device S1 are turned on. The common electrode line $V_{com}$ (A) is connected to the voltage source V1. Therefore, a voltage V1 is applied to the common electrode line $V_{com}$ (A). The common electrode line $V_{com}$ (B) is connected to the voltage source V1 through the switch device S1. Therefore, a voltage V1 is also applied to the common electrode line $V_{com}$ (B). That is that the common electrode line $V_{com}$ (A) and the common electrode line $V_{com}$ (B) have the same voltage. The voltage in the data line $D_2$ may charge the liquid crystal capacitors $C_{LC1}$ and $C_{LC1}$ and the storage capacitors $C_{st1}$ and $C_{st2}$ through the transistors $Q_1$ and $Q_2$. The data transferred in the Data line is reversed from frame K to frame K+1. Therefore, the pixel electrode 30 and the pixel electrode 31 in the sub-pixel P11 and P12 have the pixel voltage 3015. The reversed voltage level in the time segment $t_5$ may be different from that in the time segment $t_1$.

During the time segment $t_6$ in frame K+1, the scan line G3 is scanned. Therefore, the scan line G3 is in a high voltage state and the scan line G2 is in a low voltage state. The transistors $Q_1$ and $Q_2$ and the switch device S1 are turned off. The switch device S2 is turned on. The common electrode line $V_{com}$ (A) is connected to the voltage source V1. Therefore, a voltage V1 is applied to the common electrode line $V_{com}$ (A). The common electrode line $V_{com}$ (B) is connected to the voltage source V2 through the switch device S2. Therefore, a voltage V2 is applied to the common electrode line $V_{com}$ (B). The data transferred in the Data line is reversed from frame K to frame K+1. Therefore, the voltage applied to the common electrode line $V_{com}$ (B) is also reversed to voltage V3. The voltage difference between the voltage V1 and the voltage V2 and the voltage difference between the voltage V1 and the voltage V3 are related to the pixel electrodes 30 and 31. Moreover, the amplitude of an AC signal applied to the liquid crystal molecule layer may correspond to the electrical potential of the conductive electrode in the upper substrate (not shown in this figure). At the start of time segment $t_3$, the pixel electrode 30 and the pixel electrode 31 have the pixel voltage 3015 in the data line $D_2$. However, at the start of the time segment $t_6$, the voltage applied to the common electrode $V_{com}$ (B) in the sub-pixel P12 changes from V1 to V3 volts. Such a voltage change may change the voltage in the pixel electrode 31 from voltage 3015 down to the voltage 3016 through the coupling effect of the storage capacitor $C_{st2}$. On the other hand, the voltage applied to the common electrode $V_{com}$ (A) in the sub-pixel P11 keeps the voltage V1. Therefore, the voltage in the pixel electrode 30 keeps the voltage 3013. Therefore, the pixel electrode 30 and the pixel electrode 31 in the sub-pixel P11 and P12 have different voltages.

Typically, to prevent the liquid crystal molecule from being deflected in a fixed position, the voltage in the data line is changed between a positive polarity and a negative polarity. According to the present invention, the drive waveform applied to the common electrode $V_{com}$ (B) always increases the pixel voltage in the pixel electrode 31 in the frame K. After the pixel voltage in the pixel electrode 31 is modulated by the common electrode $V_{com}$ (B), the two pixel electrodes 30 and 31 have different pixel voltages. Therefore, although same data voltage in the data line is transferred to the two sub-pixels, such voltage differences between the positive polarity and the negative polarity may cause the liquid crystal molecule to be deflected at a different angle, which reduces the display quality. Therefore, different voltages are provided to the data line in the positive polarity period and in the negative polarity period to generate the same voltage change value in the pixel electrode.

In this embodiment, to prevent the pixel electrode from having different voltage changes during the periods of positive polarity and negative polarity, different voltages are provided to the data line during the period of positive polarity and during the period of negative polarity to generate the same voltage change value in the pixel electrode. Therefore, during the positive polarity period, the gray level value of the voltage 3013 is A, and in the negative polarity period, the gray level value of the voltage 3017 is B. The difference between the gray level values A and B is related to the pixel electrodes 30 and 31.

Figure 4:
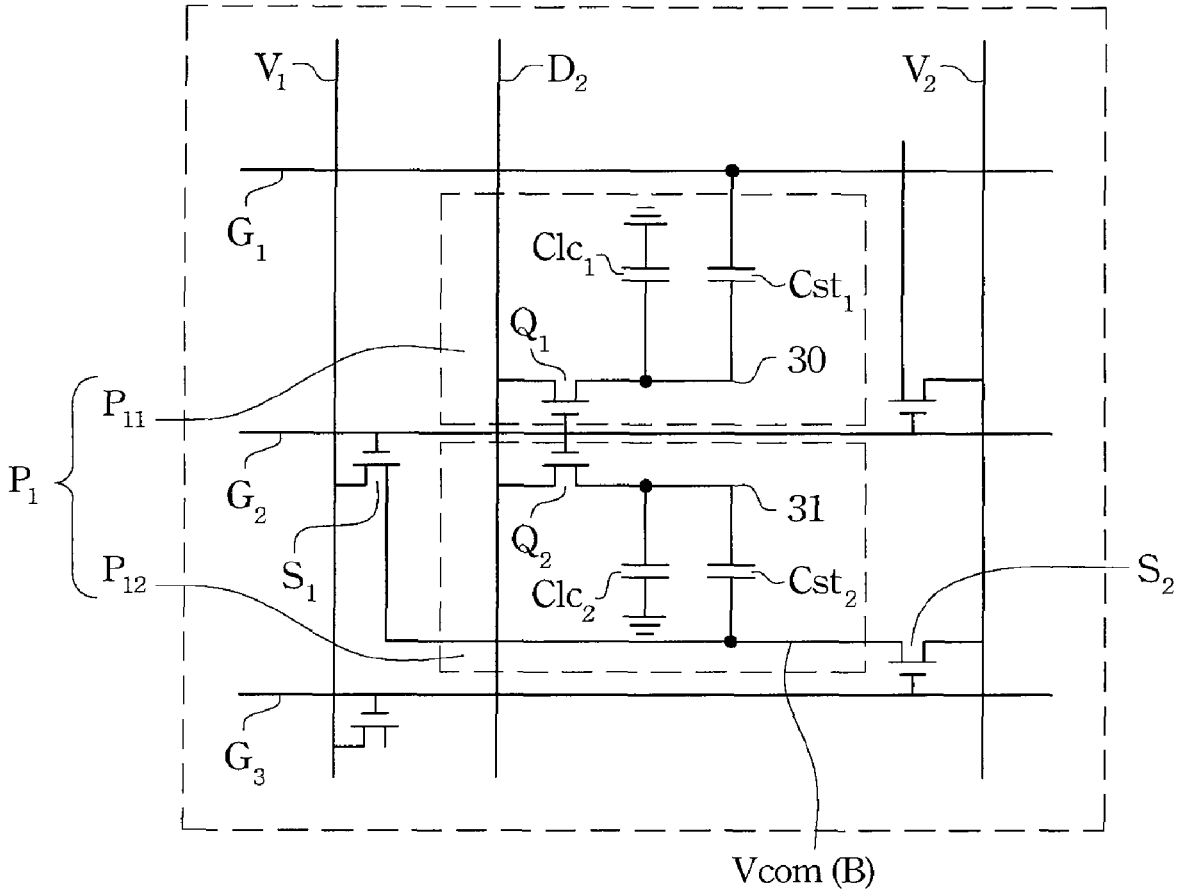
FIG. 4 illustrates an enlarged schematic diagram of a pixel unit according to the second embodiment of the present invention.

FIG. 4A illustrates a top view of a liquid crystal display according to the second embodiment of the present invention. In this embodiment, the storage capacitor $C_{st1}$ is connected to the pixel electrode 30 and the scan line G1. In other words, common electrode line $V_{com}$ (A) does not modulate the pixel electrode voltage. The operation method for modulating the pixel electrode voltage is same as that in the first embodiment.

Figure 5A:
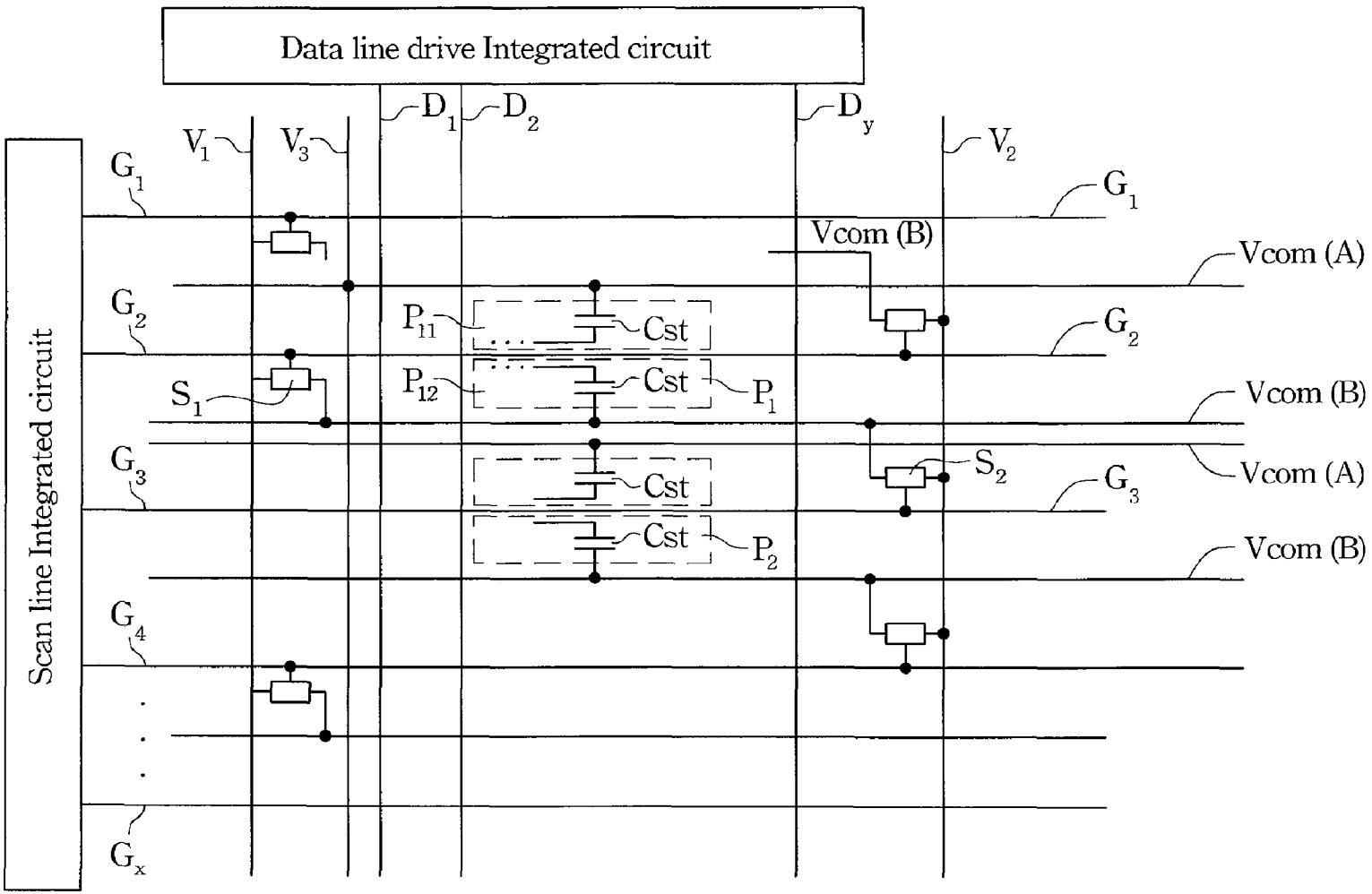
FIG. 5A illustrates a schematic diagram of a liquid crystal display according to the third embodiment of the present invention.

FIG. 5A illustrates a top view of a liquid crystal display according to the third embodiment of the present invention. The Liquid crystal display is composed of data lines D1, D2, D3, . . . , Dy, scan lines G1, G2, G3, . . . , Gx and lines $V_{com}$ (A) and $V_{com}$ (B). The data lines and the scan lines are perpendicular to each other. A data line driving integrated circuit controls the data lines D1, D2, D3, . . . , Dy. A scan line driving integrated circuit controls the scan lines G1, G2, G3, . . . , Gx. A pixel unit P1 is defined by adjacent data lines and adjacent scan lines. Two common electrode lines $V_{com}$ (A) and $V_{com}$ (B) parallel to the scan lines are arranged in the pixel unit.

According to the third embodiment of the present invention, the pixel unit P1 is divided into two sub-pixels P11 and P12. Each sub pixel P11 or P12 includes a storage capacitor $C_{st}$ that is composed of the pixel electrode and the common electrode. The storage capacitors located in different sub pixels P11 and P12 are connected to different common electrodes. The voltages applied to the common electrodes are tuned to change the voltage in the pixel electrodes in the sub pixels P11 and P12 respectively. In this embodiment, the common electrode line $V_{com}$ (B) is connected to the voltage sources V1 and V2 through two switch devices S1 and S2 respectively. Therefore, a two-step drive waveform is applied to the common electrode line $V_{com}$ (B). The scan lines G2 and G3 respectively control the switch of the switch devices S1 and S2. The common electrode line $V_{com}$ (A) is only connected to the voltage source V3. The voltage source V3 may provide different drive waveforms to change the pixel electrode voltage in the sub-pixel P11.

Figure 5B:
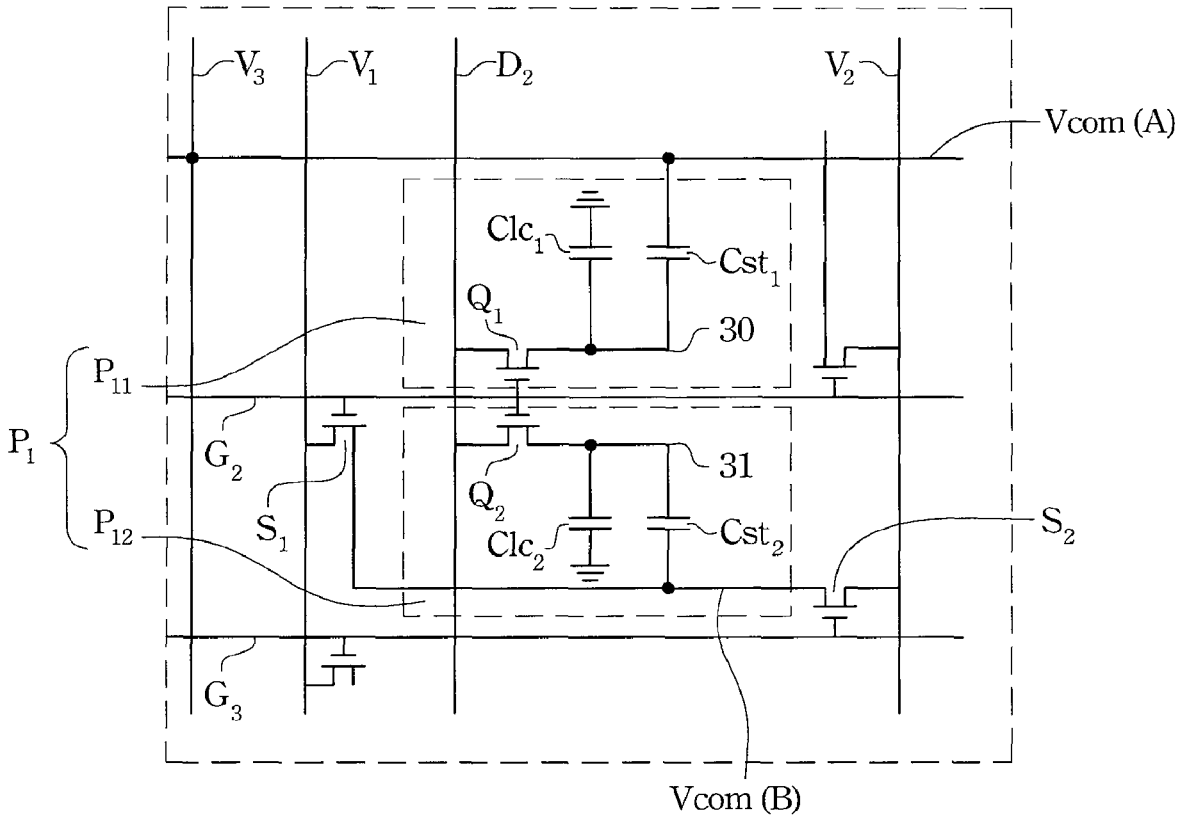
FIG. 5B illustrates an enlarged schematic diagram of a pixel unit according to the third embodiment of the present invention.

FIG. 5B illustrates an enlarged diagram of a pixel unit P1. The pixel unit P1 is defined by the data line D2 and the scan line G2. Two common electrode lines $V_{com}$ (A) and $V_{com}$ (B) parallel to the scan line G2 are arranged on both sides of the scan line G2. The pixel unit P1 is divided into two sub-pixels P11 and P12. The sub-pixel P11 is located between the scan line G2 and the common electrode $V_{com}$ (A). The sub pixel P12 is located between the scan line G2 and the common electrode $V_{com}$ (B).

The sub-pixel P11 includes a transistor $Q_1$. According to the transistor $Q_1$, the gate electrode is connected to the scan line G2, the first source/drain electrode is connected to the data line D2 and the second source/drain electrode is connected to the pixel electrode 30. The storage capacitor $C_{st1}$ is composed of the pixel electrode 30 and the common electrode $V_{com}$ (A). The liquid crystal capacitor $C_{LC1}$ is composed of the pixel electrode 30 and the conductive electrode in the upper substrate (not shown in figure).

The sub-pixel P12 also includes a transistor $Q_2$. According to the transistor $Q_2$, the gate electrode is connected to the scan line G2, the first source/drain electrode is connected to the data line D2 and the second source/drain electrode is connected to the pixel electrode 31. The storage capacitor $C_{st2}$ is composed of the pixel electrode 31 and the common electrode $V_{com}$ (B). The liquid crystal capacitor $C_{LC2}$ is composed of the pixel electrode 31 and the conductive electrode in the upper substrate (not shown in figure). When a scan voltage is applied to the scan line G2, the transistors $Q_1$ and $Q_2$ are turned on. The data voltage in the data line D2 is transferred to the pixel electrode 301 and the pixel electrode 31 and is written into the corresponding storage capacitor $C_{st1}$, the storage capacitor $C_{st2}$, the liquid crystal capacitor $C_{LC1}$ and the liquid crystal capacitor $C_{LC2}$.

In this embodiment, the common electrode line $V_{com}$ (A) is connected to the voltage source V3. The common electrode line $V_{com}$ (B) is connected to the voltage source V1 through the switch device S1 and connected to the voltage source V2 through the switch device S2. The scan line G2 controls the switch device's S1 switch device S1. The scan line G3 controls the switch of the switch device S2. In other words, the common electrode line $V_{com}$ (A) and the common electrode line $V_{com}$ (B) are not connected to the same voltage source. Therefore, the common electrode line $V_{com}$ (A) and the common electrode line $V_{com}$ (B) may modulate the voltages of the pixel electrode 30 and electrode 31 respectively. Moreover, the scan lines G2 and G3 are sequentially driven. The voltage source V1 and the voltage source V2 sequentially supply voltage to the common electrode line $V_{com}$ (B). Therefore, a two-step drive waveform is generated in the common electrode line $V_{com}$ (B). According to the present invention, the scan lines G2 and G3 are sequentially driven to respectively turn on the switch devices S1 and S2 to change the voltage source connected to the common electrode line $V_{com}$ (B). By the coupling effect of the storage capacitor $C_{st2}$, different voltages are applied to the pixel electrode 31 to make the two sub-pixels P11 and P12 have different pixel voltages.

Figure 5C:
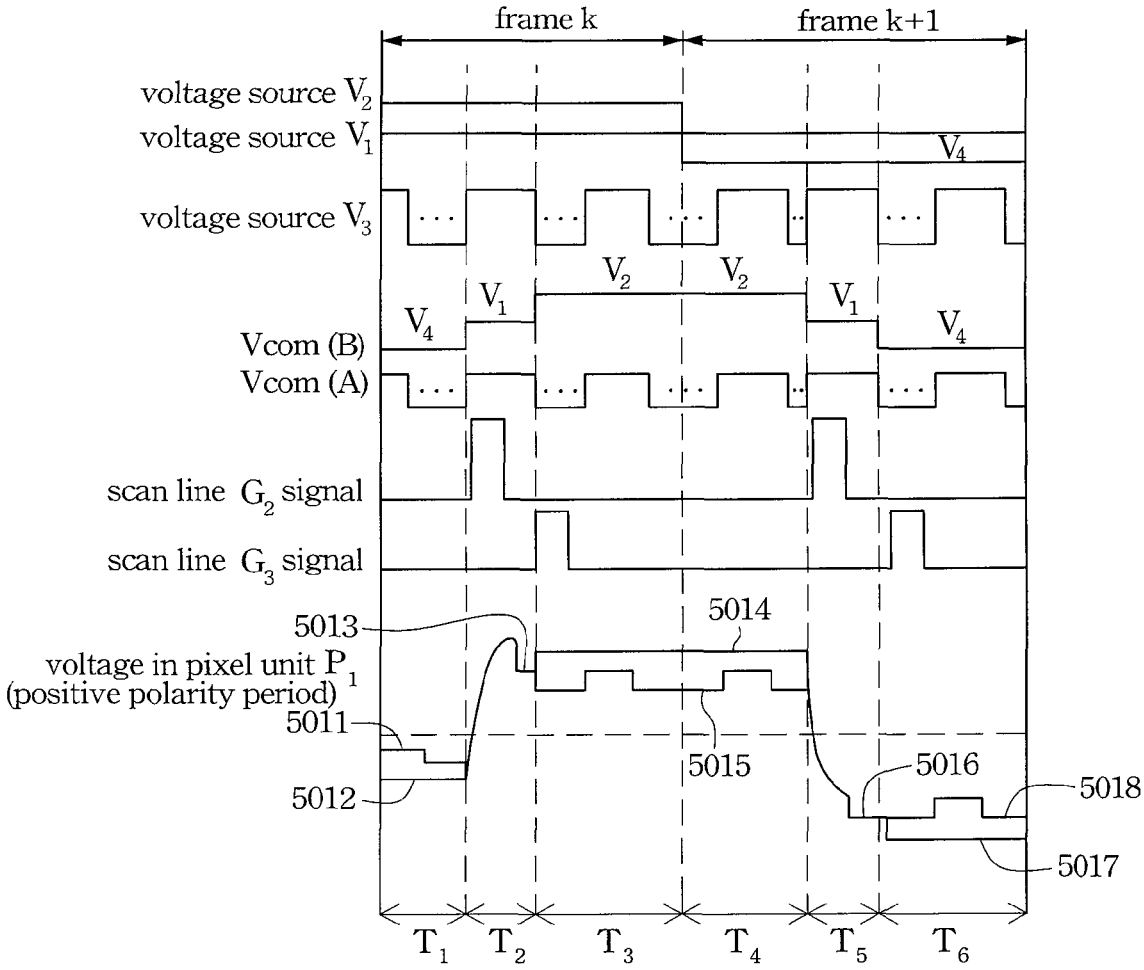
FIG. 5C illustrates drive waveforms for the common electrodes according to the third embodiment of the present invention.

FIG. 5C illustrates a drive waveform for driving a liquid crystal display according to the third embodiment of the present invention. In this embodiment, the voltage source V3 provides a drive voltage with an oscillating waveform. The amplitude and frequency of the oscillating waveform may be changed. The oscillating waveform has an average voltage value.

With reference to FIGS. 5B and 5C. During the time segment $t_1$ in frame K, the scan line G2 is in a low voltage state. Therefore, the transistors $Q_1$ and $Q_2$ and the switch devices S1 and S2 are turned off. The common electrode line $V_{com}$ (A) is connected to the voltage source V3. Therefore, a drive voltage with oscillating waveform is applied to the common electrode line $V_{com}$ (A). The switch devices S1 and S2 are turned off, therefore, the common electrode line $V_{com}$ (B) has the same voltage state as the previous time segment. Therefore, the voltage states in the liquid crystal capacitors $C_{LC1}$ and $C_{LC2}$ and the voltage states in the storage capacitors $C_{st1}$ and $C_{st2}$ are same as in the previous time segment. In this case, the pixel electrode 30 in the sub-pixel P11 has the pixel voltage 5011 and the pixel electrode 31 in the sub-pixel P12 has the pixel voltage 5012. Because the drive voltage in the common electrode line $V_{com}$ (A) has an oscillating waveform, the voltage in the pixel electrode 30 also has an oscillating waveform through the coupling effect of the storage capacitors $C_{st1}$.

During the time segment $t_2$ in frame K, the scan line G2 is in a high voltage state. Therefore, the transistors $Q_1$ and $Q_2$ and the switch device S1 are turned on. The common electrode line $V_{com}$ (A) is connected to the voltage source V3. Therefore, a drive voltage with oscillating waveform is applied to the common electrode line $V_{com}$ (A). The common electrode line $V_{com}$ (B) is connected to the voltage source V1 through the switch device S1. Therefore, a voltage V1 is also applied to the common electrode line $V_{com}$ (B). The voltage in the data line $D_2$ may charge the liquid crystal capacitors $C_{LC1}$ and $C_{LC2}$ and the storage capacitors $C_{st1}$ and $C_{st2}$ through the transistors $Q_1$ and $Q_2$. At this time, the pixel electrode 30 and the pixel electrode 31 in the sub-pixel P11 and P12 have the pixel voltage 5013 in the data line $D_2$.

During the time segment $t_3$ in frame K, the scan line G3 is scanned. Therefore, the scan line G3 is in a high voltage state and the scan line G2 is in a low voltage state. The transistors $Q_1$ and $Q_2$ and the switch device S1 are turned off. The switch device S2 is turned on. The common electrode line $V_{com}$ (A) is connected to the voltage source V3. Therefore, a drive voltage with oscillating waveform is applied to the common electrode line $V_{com}$ (A). The common electrode line $V_{com}$ (B) is connected to the voltage source V2 through the switch device S2. Therefore, a voltage V2 is applied to the common electrode line $V_{com}$ (B). At the start of time segment $t_3$, the pixel electrode 30 and the pixel electrode 31 have the pixel voltage 5013 in the data line $D_2$. However, at the start of the time segment $t_3$, the voltage applied to the common electrode $V_{com}$ (B) in the sub-pixel P12 changes from V1 to V2 volts. Such a voltage change may change the voltage in the pixel electrode 31 from voltage 5013 up to the voltage 5014 through the coupling effect of the storage capacitor $C_{st2}$. On the other hand, the voltage applied to the common electrode $V_{com}$ (A) in the sub-pixel P11 has an oscillating waveform. Therefore, the voltage 5015 in the pixel electrode 30 also has an oscillating waveform through the coupling effect of the storage capacitors $C_{st1}$. Therefore, the voltage in the pixel electrode 30 keeps the voltage 3013. Therefore, the pixel electrode 30 and the pixel electrode 31 in the sub-pixel P11 and P12 have different voltages.

Next, during the time segment $t_4$ in frame K+1, the scan lines are scanned again. The scan line G2 is not scanned. Therefore, the scan line G2 is in a low voltage state. Therefore, the transistors $Q_1$ and $Q_2$ and the switch devices S1 and S2 are turned off. The common electrode line $V_{com}$ (A) is connected to the voltage source V3. Therefore, a drive voltage with oscillating waveform is applied to the common electrode line $V_{com}$ (A). The common electrode line $V_{com}$ (B) keeps the voltage V2 due to the storage capacitors $C_{st1}$. Therefore, the voltage states in the liquid crystal capacitors $C_{LC1}$ and $C_{LC2}$ and the voltage states in the storage capacitors $C_{st1}$ and $C_{st2}$ are same as in the previous time segment $t_3$. In this case, the pixel electrode 30 in the sub-pixel P11 has the pixel voltage 5015 and the pixel electrode 31 in the sub-pixel P12 has the pixel voltage 5014.

During the time segment $t_5$ in frame K+1, the scan line G2 is scanned. Therefore, the scan line G2 is in a high voltage state. Therefore, the transistors $Q_1$ and $Q_2$ and the switch device S1 are turned on. The common electrode line $V_{com}$ (A) is connected to the voltage source V1. Therefore, a drive voltage with oscillating waveform is applied to the common electrode line $V_{com}$ (A). The common electrode line $V_{com}$ (B) is connected to the voltage source V1 through the switch device S1. Therefore, a voltage V1 is applied to the common electrode line $V_{com}$ (B). The voltage in the data line $D_2$ may charge the liquid crystal capacitors $C_{LC1}$ and $C_{LC2}$ and the storage capacitors $C_{st1}$ and $C_{st2}$ through the transistors $Q_1$ and $Q_2$. The data transferred in the data line is reversed from frame K to frame K+1. Therefore, the pixel electrode 30 and the pixel electrode 31 in the sub-pixels P11 and P12 have the pixel voltage 5016. The reversed voltage level in the time segment $t_5$ may be different from that in the time segment $t_1$. However, the voltage difference between the pixel electrode 30 and the conductive electrode in the upper substrate is equal to that between the pixel electrode 31 and the conductive electrode in the upper substrate.

During the time segment $t_6$ in frame K+1, the scan line G3 is scanned. Therefore, the scan line G3 is in a high voltage state and the scan line G2 is in a low voltage state. The transistors $Q_1$ and $Q_2$ and the switch device S1 are turned off. The switch device S2 is turned on. The common electrode line $V_{com}$ (A) is connected to the voltage source V1. Therefore, a drive voltage with oscillating waveform is applied to the common electrode line $V_{com}$ (A). The common electrode line $V_{com}$ (B) is connected to the voltage source V2 through the switch device S2. Therefore, a voltage V2 is applied to the common electrode line $V_{com}$ (B). The data transferred in the Data line is reversed from frame K to frame K+1. Therefore, the voltage applied to the common electrode line $V_{com}$ (B) is also reversed to voltage V4. The voltage difference between the voltage V1 and the voltage V2 and the voltage difference between the voltage V1 and the voltage V4 are related to the pixel electrodes 30 and 31. Moreover, the amplitude of an AC signal applied to the liquid crystal molecule layer corresponds to the electrical potential of the conductive electrode in the upper substrate (not shown in this figure). At the start of time segment $t_6$, the pixel electrode 30 and the pixel electrode 31 have the pixel voltage 5016 in the data line $D_2$. However, at the start of the time segment $t_6$, the voltage applied to the common electrode $V_{com}$ (B) in the sub-pixel P12 changes from V1 to V4 volts. Such a voltage change may change the voltage in the pixel electrode 31 from voltage 5016 down to the voltage 5017 through the coupling effect of the storage capacitor $C_{st2}$. On the other hand, the voltage applied to the common electrode $V_{com}$ (A) in the sub-pixel P11 is an oscillating waveform. Therefore, the voltage 5018 in the pixel electrode 30 also has an oscillating waveform through the coupling effect of the storage capacitors $C_{st1}$. Therefore, the pixel electrode 30 and the pixel electrode 31 in the sub-pixel P11 and P12 have different voltages. As shown in FIG. 5B, because the voltage applied to the common electrode $V_{com}$ (A) in the sub-pixel P11 is an oscillating waveform, the capacitance of the storage capacitor is modulated by the common electrode $V_{com}$ (A). Such modulated voltages may generate the same voltage change value in the pixel electrode in the positive polarity period and in the negative polarity period.

Figure 6A:
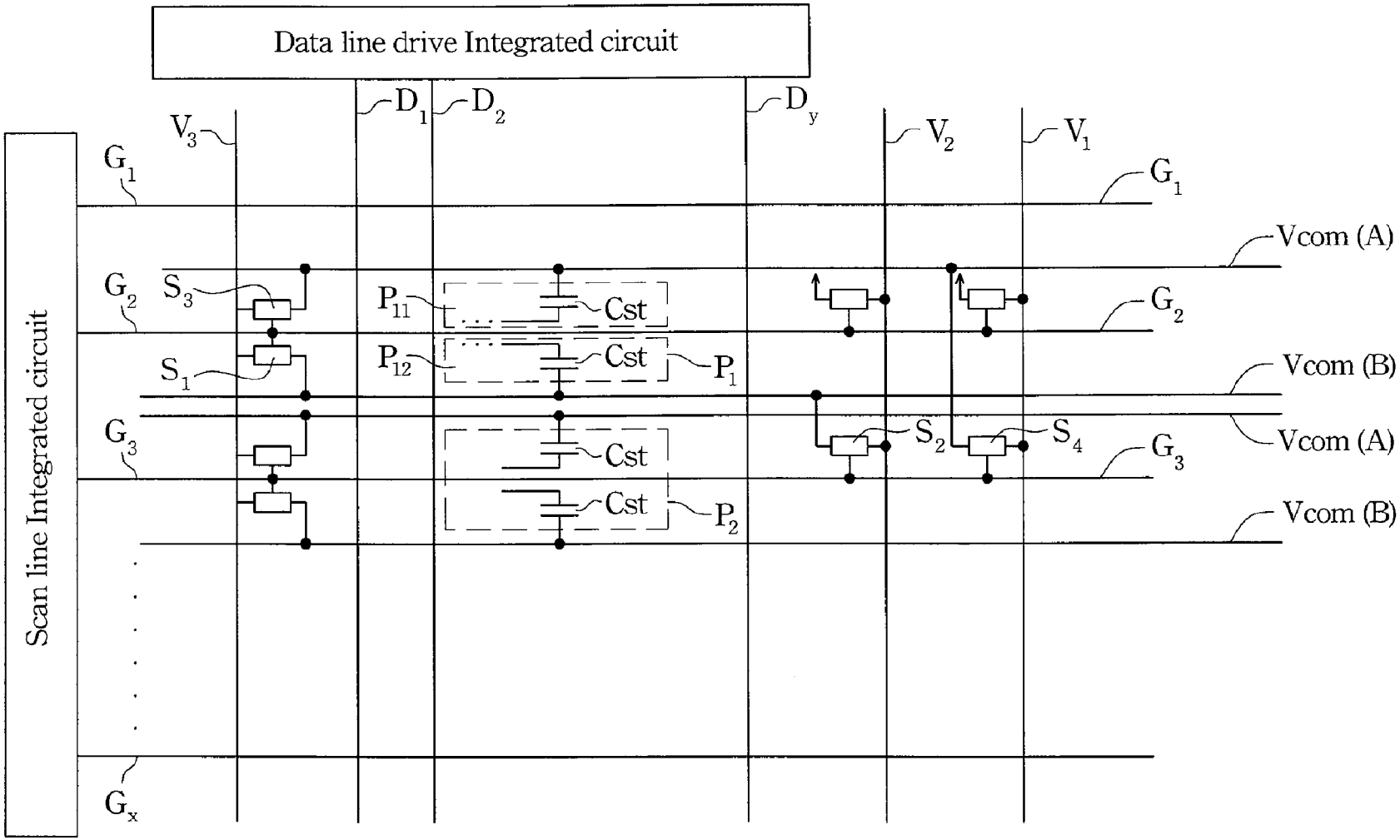
FIG. 6A illustrates a schematic diagram of a liquid crystal display according to the fourth embodiment of the present invention.

FIG. 6A illustrates a top view of a liquid crystal display according to the fourth embodiment of the present invention. The liquid crystal display is composed of data lines D1, D2, D3, . . . , Dy, scan lines G1, G2, G3, . . . , Gx and lines $V_{com}$ (A) and $V_{com}$ (B). The data lines and the scan lines are perpendicular to each other. A data line driving integrated circuit controls the data lines D1, D2, D3, . . . , Dy. A scan line driving integrated circuit controls the scan lines G1, G2, G3, . . . , Gx. A pixel unit P1 is defined by adjacent data lines and adjacent scan lines. Two common electrode lines $V_{com}$ (A) and $V_{com}$ (B) parallel to the scan lines are arranged in the pixel unit.

According to the fourth embodiment of the present invention, the pixel unit P1 is divided into two sub-pixels P11 and P12. Each sub pixel P11 or P12 includes a storage capacitor $C_{st}$ that is composed of the pixel electrode and the common electrode. The storage capacitors located in different sub pixels P11 and P12 are connected to different common electrodes. The voltages applied to the common electrodes are tuned to change the voltage in the pixel electrodes in the sub pixels P11 and P12 respectively.

In this embodiment, the common electrode line $V_{com}$ (A) is connected to the voltage sources V1 and V3 through two switch devices S3 and S2 respectively. Therefore, a three-step drive waveform is applied to the common electrode line $V_{com}$ (A). The scan lines G2 and G3 respectively control the switch of the switch devices S3 and S4. On the other hand, the common electrode line $V_{com}$ (B) is connected to the voltage sources V1 and V2 through two switch devices S3 and S2 respectively. Therefore, a three-step drive waveform is applied to the common electrode line $V_{com}$ (B). The scan lines G2 and G3 respectively control the switch of the switch devices S1 and S2.

Figure 6B:
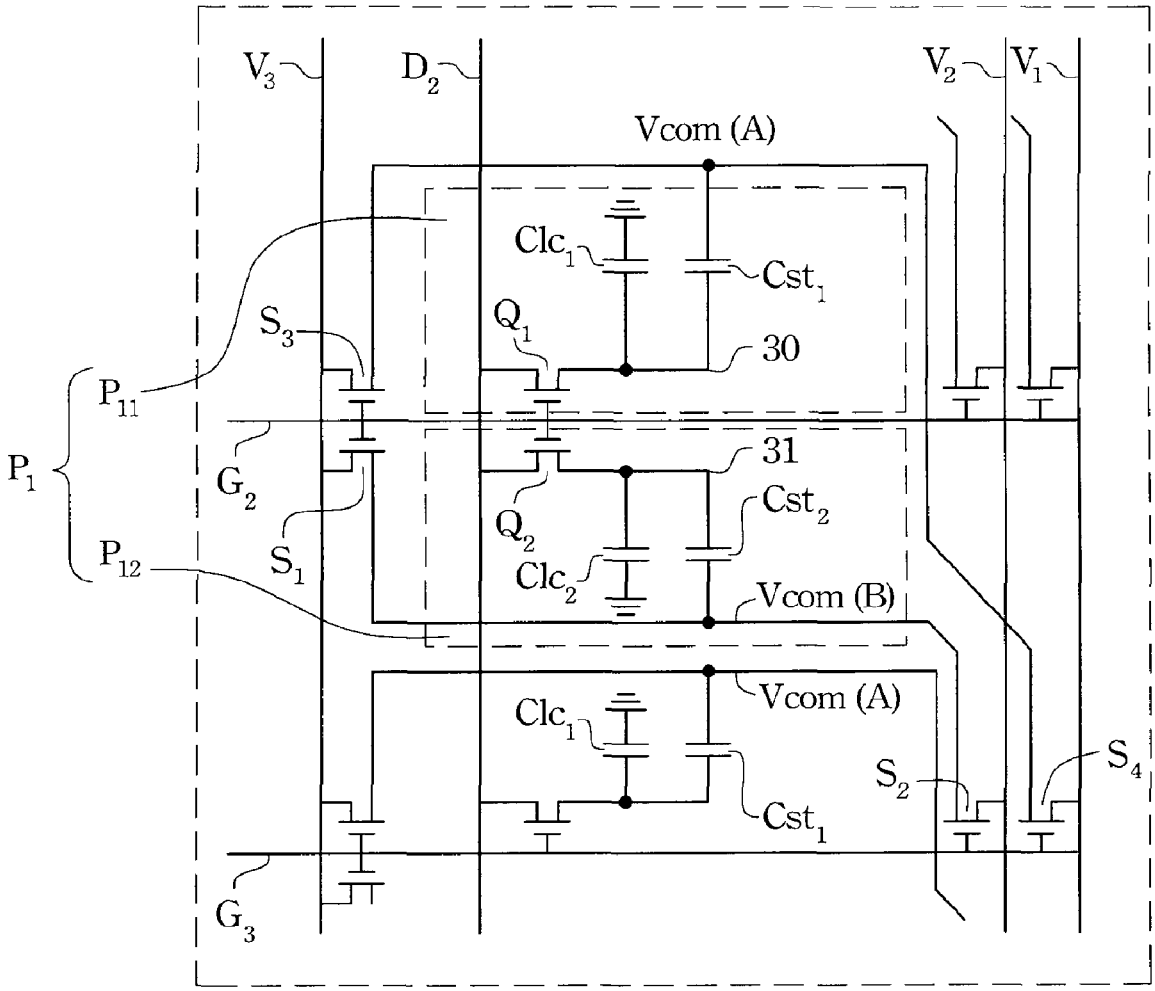
FIG. 6B illustrates an enlarged schematic diagram of a pixel unit according to the fourth embodiment of the present invention.

According to this embodiment, the voltage source V1 provides a 4 volt voltage, wherein this 4 volt voltage is transformed to a voltage with the same voltage level or different voltage levels between two adjacent frames. The voltage source V2 provides a 6 volt voltage, wherein this 6 volt voltage is transformed to a voltage with the same voltage level or different voltage levels between two adjacent frames. The voltage source V3 provides a 5 volt voltage. Different voltage sources also can be used in the present invention. For example, the voltage source V1 provides a 7 volt voltage. The voltage source V2 provides a 6 volt voltage. The voltage source V3 provides a 5 volt voltage FIG. 6B illustrates an enlarged diagram of a pixel unit P1. The pixel unit P1 is defined by the data line D2 and the scan line G2. Two common electrode lines $V_{com}$ (A) and $V_{com}$ (B) parallel to the scan line G2 are arranged on both sides of the scan line G2. The pixel unit P1 is divided into two sub-pixels P11 and P12. The sub-pixel P11 is located between the scan line G2 and the common electrode $V_{com}$ (A). The sub pixel P12 is located between the scan line G2 and the common electrode $V_{com}$ (B).

The sub-pixel P11 includes a transistor $Q_1$. According to the transistor $Q_1$, the gate electrode is connected to the scan line G2, the first source/drain electrode is connected to the data line D2 and the second source/drain electrode is connected to the pixel electrode 30. The storage capacitor $C_{st1}$ is composed of the pixel electrode 30 and the common electrode $V_{com}$ (A). The liquid crystal capacitor $C_{LC1}$ is composed of the pixel electrode 30 and the conductive electrode in the upper substrate (not shown in figure).

The sub-pixel P12 also includes a transistor $Q_2$. According to the transistor $Q_2$, the gate electrode is connected to the scan line G2, the first source/drain electrode is connected to the data line D2 and the second source/drain electrode is connected to the pixel electrode 31. The storage capacitor $C_{st2}$ is composed of the pixel electrode 31 and the common electrode $V_{com}$ (B). The liquid crystal capacitor $C_{LC2}$ is composed of the pixel electrode 31 and the conductive electrode in the upper substrate (not shown in figure). When a scan voltage is applied to the scan line G2, the transistors $Q_1$ and $Q_2$ are turned on. The data voltage in the data line D2 is transferred to the pixel electrode 30 and the pixel electrode 31 and is written into the corresponding storage capacitor $C_{st1}$ the storage capacitor $C_{st2}$, the liquid crystal capacitor $C_{LC1}$ and the liquid crystal capacitor $C_{LC2}$.

In this embodiment, the common electrode line $V_{com}$ (A) is connected to the voltage source V3 through the switch device S3 and is connected to the voltage source V1 through the switch device S4. The common electrode line $V_{com}$ (B) is connected to the voltage source V3 through the switch device S1 and connected to the voltage source V2 through the switch device S2. The scan line G2 controls the switch of the switch devices S1 and S3. The scan line G3 controls the switch of the switch devices S2 and. The voltage source V3 and the voltage source V1 sequentially supply voltages to the common electrode line $V_{com}$ (A). The voltage source V3 and the voltage source V2 may also sequentially supply voltage to the common electrode line $V_{com}$ (B). Therefore, a three-step drive waveform is generated in the common electrode line $V_{com}$ (A) and in the common electrode line $V_{com}$ (B) respectively. According to the present invention, the scan lines G2 and G3 are sequentially driven to respectively turn on the switch devices S1, S3 and the switch devices S2, S4 to change the voltage source connected to the common electrode line $V_{com}$ (A) and the common electrode line $V_{com}$ (B). By the coupling effect of the storage capacitors $C_{st1}$ and $C_{st2}$, different voltages are applied to the pixel electrodes 30 and 31 to make the two sub-pixels P11 and P12 have different pixel voltages.

Figure 6C:
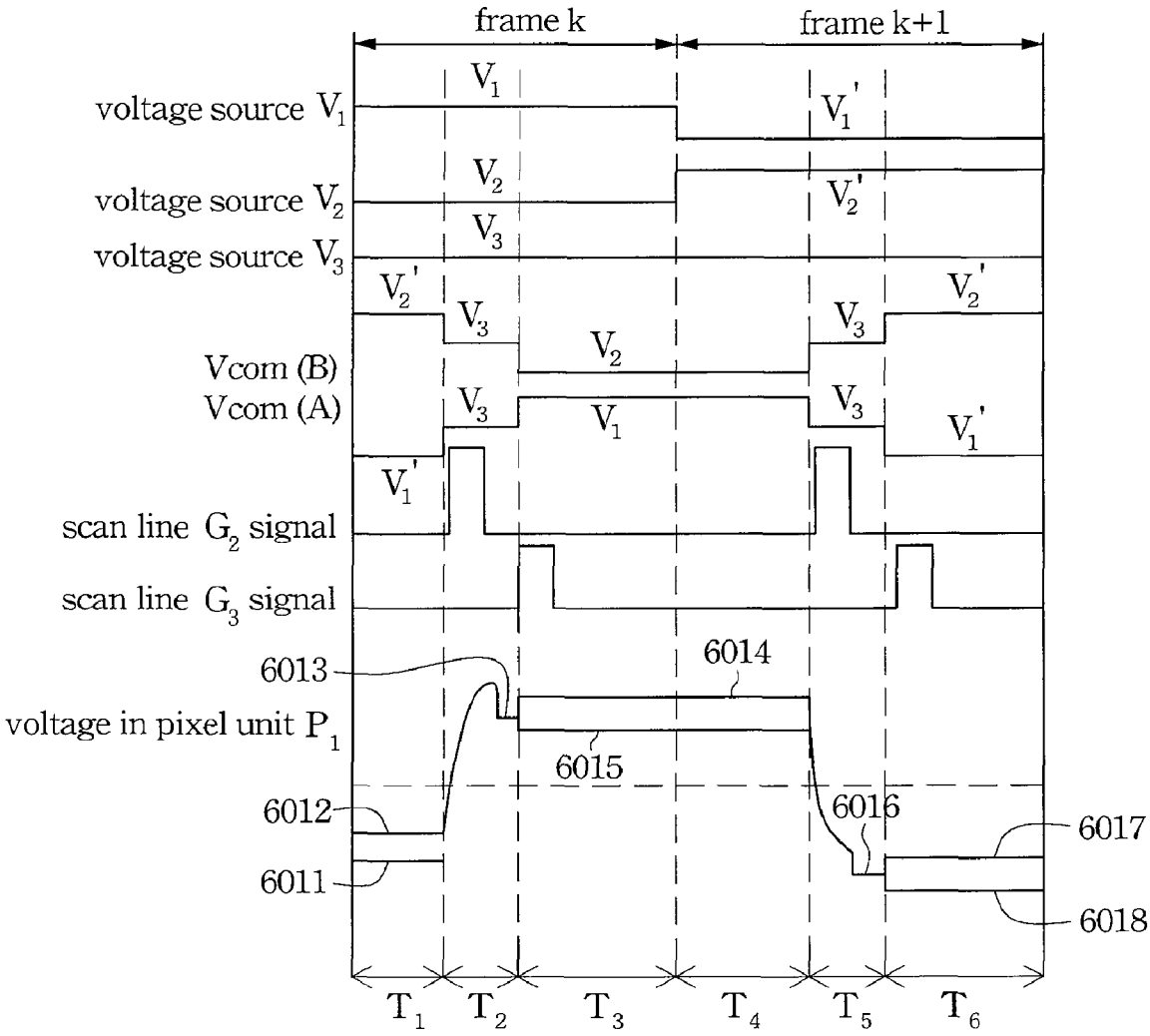
FIG. 6C illustrates drive waveforms for the common electrodes according to the fourth embodiment of the present invention.

FIG. 6C illustrates a drive waveform to drive a liquid crystal display according to the fourth embodiment of the present invention. In this embodiment, the voltage V1 is larger than the voltage V2 and the voltage V2 is larger than the voltage V3.

With reference to FIGS. 6B and 6C, during the time segment $t_1$ in frame K, the scan line G2 is in a low voltage state. Therefore, the transistors $Q_1$ and $Q_2$ and the switch devices S1, S2, S3 and S4 are turned off. The common electrode line $V_{com}$ (A) and the common electrode line $V_{com}$ (B) have the voltage state same as the previous time segment. Therefore, the voltage states in the liquid crystal capacitors $C_{LC1}$ and $C_{LC2}$ and the voltage states in the storage capacitors $C_{st1}$, and $C_{st2}$ are same as that in the previous time segment. In this case, the pixel electrode 30 in the sub-pixel P11 has the pixel voltage 6011 and the pixel electrode 31 in the sub-pixel P12 has the pixel voltage 6012.

During the time segment $t_2$ in frame K, the scan line G2 is in a high voltage state. Therefore, the transistors $Q_1$ and $Q_2$ and the switch device S1 and S3 are turned on. Both the common electrode line $V_{com}$ (A) and the common electrode line $V_{com}$ (B) are connected to the voltage source V3. Therefore, a voltage V3 are applied to the common electrode line $V_{com}$ (A) and the common electrode line $V_{com}$ (B). The voltage in the data line $D_2$ may charge the liquid crystal capacitors $C_{LC1}$ and $C_{LC2}$ and the storage capacitors $C_{st1}$ and $C_{st2}$ through the transistors $Q_1$ and $Q_2$. At this time, the pixel electrode 30 and the pixel electrode 31 in the sub-pixel P11 and P12 have the pixel voltage 6013 in the data line $D_2$.

During the time segment $t_3$ in frame K, the scan line G3 is scanned. Therefore, the scan line G3 is in a high voltage state and the scan line G2 is in a low voltage state. The transistors $Q_1$ and $Q_2$ and the switch devices S1 and S3 are turned off. The switch device S2 and S4 are turned on. The common electrode line $V_{com}$ (A) is connected to the voltage source V1 through the switch device S4. Therefore, a voltage V1 is applied to the common electrode line $V_{com}$ (A). The common electrode line $V_{com}$ (B) is connected to the voltage source V2 through the switch device S2. Therefore, a voltage V2 is applied to the common electrode line $V_{com}$ (B). At the start of time segment $t_3$, the pixel electrode 30 and the pixel electrode 31 have the pixel voltage 6013 in the data line $D_2$. However, at the start of the time segment $t_3$, the voltage applied to the common electrode $V_{com}$ (A) in the sub-pixel P11 changes from V3 to V1 volts. Such a voltage change may change the voltage in the pixel electrode 30 from voltage 6013 up to the voltage 6014 through the coupling effect of the storage capacitor $C_{st1}$. On the other hand, the voltage applied to the common electrode $V_{com}$ (B) in the sub-pixel P12 changes from V3 to V2 volts. Such a voltage change may change the voltage in the pixel electrode 31 from voltage 6013 down to the voltage 6015 through the coupling effect of the storage capacitor $C_{st2}$. Therefore, the pixel electrode 30 and the pixel electrode 31 in the sub-pixel P11 and P12 have different voltages.

Next, during the time segment $t_4$ in frame K+1, the scan lines are scanned again and the voltage supplied by the voltage source V1 and V2 is transformed. The scan line G2 is not scanned. Therefore, the scan line G2 is in a low voltage state. Therefore, the transistors $Q_1$ and $Q_2$ and the switch devices S1, S2, S3 and S4 are turned off. The common electrode line $V_{com}$ (A) and the common electrode line $V_{com}$ (B) keep in the voltage state same as that in the previous time segment $t_3$. In this case, the pixel electrode 30 in the sub-pixel P11 has the pixel voltage 6014 and the pixel electrode 31 in the sub-pixel P12 has the pixel voltage 6015.

During the time segment $t_5$ in frame K+1, the scan line G2 is scanned. Therefore, the scan line G2 is in a high voltage state. Therefore, the transistors $Q_1$ and $Q_2$ and the switch devices S1 and S3 are turned on. Both the common electrode line $V_{com}$ (A) and the common electrode line $V_{com}$ (B) are connected to the voltage source V3. Therefore, a voltage V3 is applied to the common electrode line $V_{com}$ (A) and common electrode line $V_{com}$ (B). The voltage in the data line D2 may charge the liquid crystal capacitors $C_{LC1}$ and $C_{LC1}$ and the storage capacitors $C_{st1}$ and $C_{st2}$ through the transistors $Q_1$ and $Q_2$. The data transferred in the Data line is reversed from frame K to frame K+1. Therefore, the pixel electrode 30 and the pixel electrode 31 in the sub-pixel P11 and P12 have the pixel voltage 6016.

During the time segment $t_6$ in frame K+1, the scan line G3 is scanned. Therefore, the scan line G3 is in a high voltage state and the scan line G2 is in a low voltage state. The transistors $Q_1$ and $Q_2$ and the switch device S1 and S3 are turned off. The switch devices S2 and S4 are turned on. The common electrode line $V_{com}$ (A) is connected to the voltage source V1 through the switch device S4. Therefore, a transformed voltage V1' is applied to the common electrode line $V_{com}$ (A). The common electrode line $V_{com}$ (B) is connected to the voltage source V2 through the switch device S2. Therefore, a transformed voltage V2' is applied to the common electrode line $V_{com}$ (B). The voltage difference between the voltage V3 and the voltage V2 and the voltage difference between the voltage V3 and the voltage V2' are related to the pixel electrodes 30 and 31. Moreover, the amplitude of an AC signal applied to the liquid crystal molecule layer may correspond to the electrical potential of the conductive electrode in the upper substrate (not shown in this figure). At the start of time segment $t_6$, the pixel electrode 30 and the pixel electrode 31 have the pixel voltage 6016 in the data line $D_2$. However, at the start of the time segment $t_6$, the voltage applied to the common electrode $V_{com}$ (B) in the sub-pixel P12 changes from V3 to V2' volts. Such a voltage change may change the voltage in the pixel electrode 31 from voltage 6016 up to the voltage 6017 through the coupling effect of the storage capacitor $C_{st2}$. On the other hand, the voltage applied to the common electrode $V_{com}$ (A) in the sub-pixel P11 changes from V3 to V1' volts. Such a voltage change may change the voltage in the pixel electrode 30 from voltage 6016 down to the voltage 6018 through the coupling effect of the storage capacitor $C_{st1}$. Therefore, the pixel electrode 30 and the pixel electrode 31 in the sub-pixel P11 and P12 have different voltages.

Figure 6D:
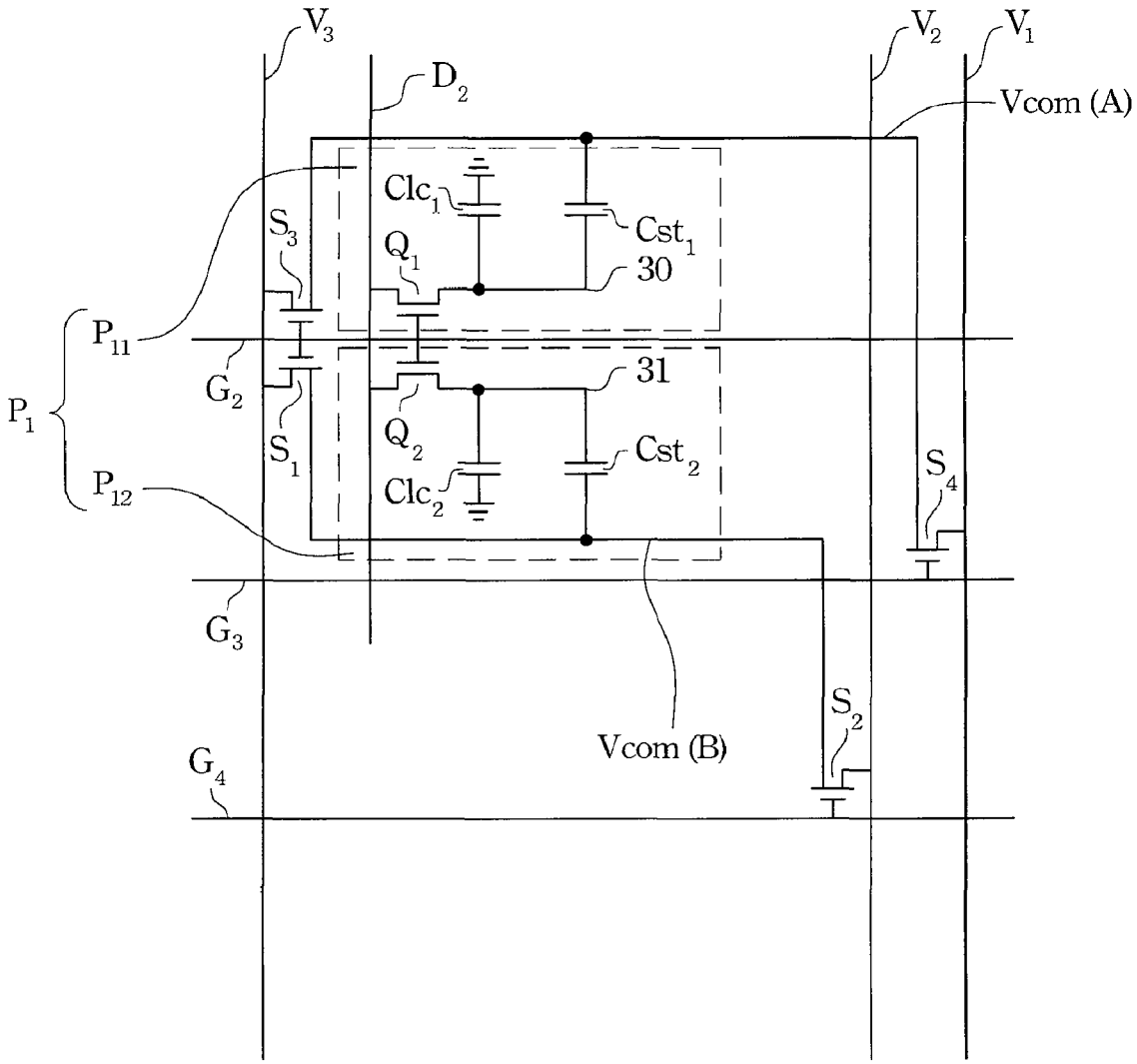
FIG. 6D illustrates an enlarged schematic diagram of a pixel unit according to the fifth embodiment of the present invention.

FIG. 6D illustrates a top view of a Pixel unit according to the fifth embodiment of the present invention. In this embodiment, the common electrode line $V_{com}$ (A) is connected to the voltage source V3 through the switch device S3 and is connected to the voltage source V1 through the switch device S4. The common electrode line $V_{com}$ (B) is connected to the voltage source V3 through the switch device S1 and connected to the voltage source V2 through the switch device S2. The scan line G2 controls the switch of the switch devices S1 and S3. The scan line G4 controls the switch of the switch device S2. The scan line G3 controls the switch of the switch device S4. The scan lines G2, G3 and G4 are sequentially driven. The voltage source V3 and the voltage source V1 sequentially supply voltage to the common electrode line $V_{com}$ (A). The voltage source V3 and the voltage source V2 may also sequentially supply voltage to the common electrode line $V_{com}$ (B). Therefore, a three-step drive waveform is generated in the common electrode line $V_{com}$ (A) and in the common electrode line $V_{com}$ (B) respectively. According to this embodiment, the scan lines G2, G3 and G4 are sequentially driven to respectively turn on the switch devices S1, S3, the switch devices S4 and the switch device S2 to change the voltage source connected to the common electrode line $V_{com}$ (A) and the common electrode line $V_{com}$ (B). By the coupling effect of the storage capacitors $C_{st1}$ and $C_{st2}$, different voltages are applied to the pixel electrodes 30 and 31 to make the two sub-pixels P11 and P12 have different pixel voltages.

Figure 6E:
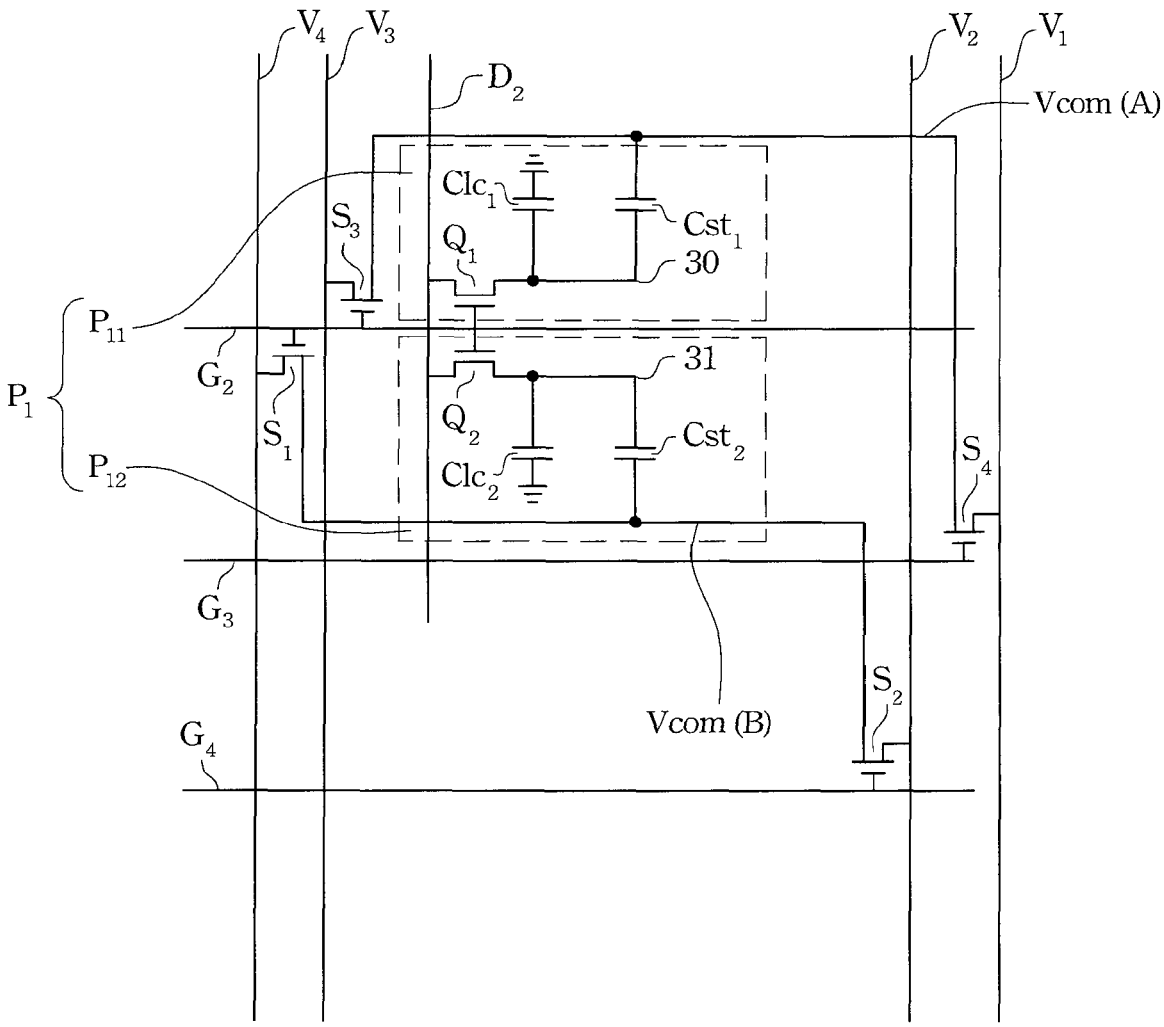
FIG. 6E illustrates an enlarged schematic diagram of a pixel unit according to the sixth embodiment of the present invention.

FIG. 6E illustrates a top view of a pixel unit according to the sixth embodiment of the present invention. Four voltage sources are used in this embodiment to modulate the voltage of the common electrode line $V_{com}$ (A) and the common electrode line $V_{com}$ (B). The common electrode line $V_{com}$ (A) is connected to the voltage source V3 through the switch device S3 and is connected to the voltage source V1 through the switch device S4. The common electrode line $V_{com}$ (B) is connected to the voltage source V4 through the switch device S1 and connected to the voltage source V2 through the switch device S2. The scan line G2 controls the switch of the switch devices S1 and S2. The scan line G4 controls the switch of the switch device S2. The scan line G3 the switch of the switch device S4. The scan lines G2, G3 and G4 are sequentially driven. The voltage source V3 and the voltage source V1 sequentially supply voltage to the common electrode line $V_{com}$ (A). The voltage source V4 and the voltage source V2 may also sequentially supply voltage to the common electrode line $V_{com}$ (B). According to this embodiment, the scan lines G2, G3 and G4 are sequentially driven to respectively turn on the switch devices S1, S3, the switch devices S4 and the switch device S2 to change the voltage source connected to the common electrode line $V_{com}$ (A) and the common electrode line $V_{com}$ (B). By the coupling effect of the storage capacitors $C_{st1}$ and $C_{st2}$, different voltages are applied to the pixel electrodes 30 and 31 to make the two sub-pixels P11 and P12 have different pixel voltages.

Figure 6F:
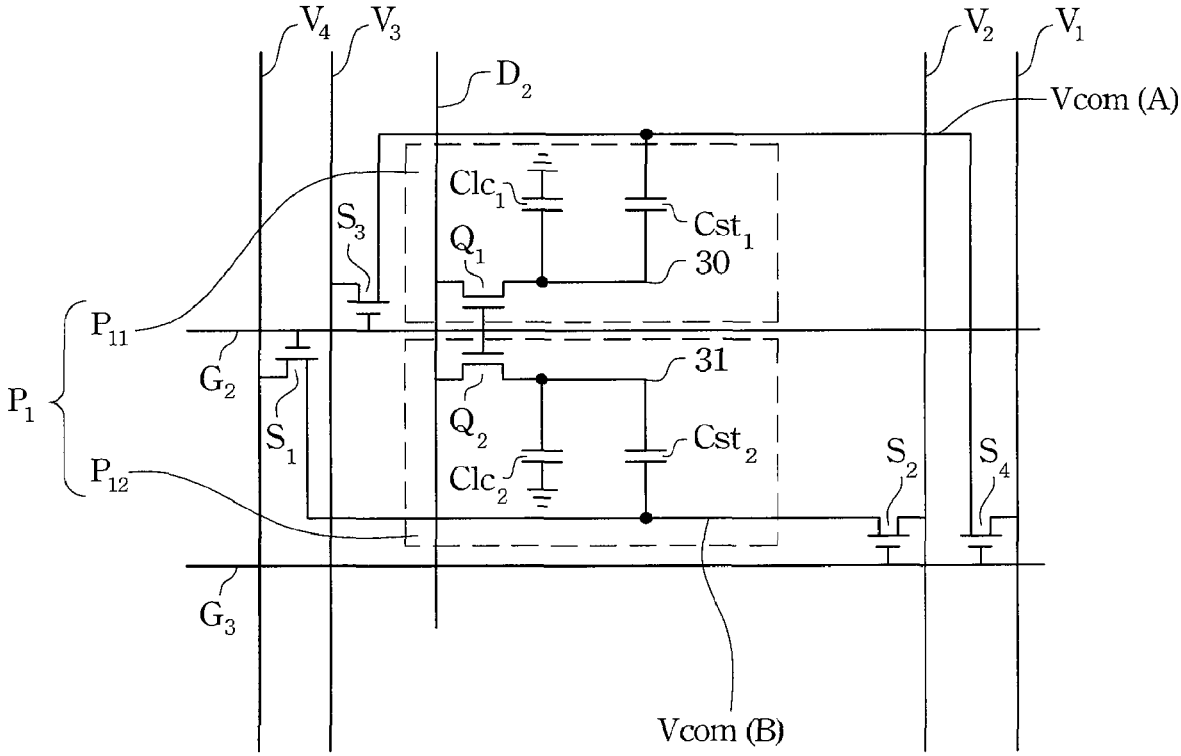
FIG. 6F illustrates an enlarged schematic diagram of a pixel unit according to the seventh embodiment of the present invention.

FIG. 6F illustrates a top view of a Pixel unit according to the seventh embodiment of the present invention. Four voltage sources are used in this embodiment to modulate the voltage of the common electrode line $V_{com}$ (A) and the common electrode line $V_{com}$ (B). The common electrode line $V_{com}$ (A) is connected to the voltage source V3 through the switch device S3 and is connected to the voltage source V1 through the switch device S4. The common electrode line $V_{com}$ (B) is connected to the voltage source V4 through the switch device S1 and connected to the voltage source V2 through the switch device S2. The scan line G2 controls the switch of the switch devices S1 and S3. The scan line G3 control the switch of the switch devices S2 and S4. The scan lines G2 and G3 are sequentially driven. The voltage source V3 and the voltage source V1 sequentially supply voltage to the common electrode line $V_{com}$ (A). The voltage source V4 and the voltage source V2 may also sequentially supply voltage to the common electrode line $V_{com}$ (B). According to this embodiment, the scan lines G2 and G3 are sequentially driven to respectively turn on the switch devices S1, S3 and the switch devices S4, S2 to change the voltage source connected to the common electrode line $V_{com}$ (A) and the common electrode line $V_{com}$ (B). By the coupling effect of the storage capacitors $C_{st1}$ and $C_{st2}$ different voltages are applied to the pixel electrodes 30 and 31 to make the two sub-pixels P11 and P12 have different pixel voltages.

Figure 7A:
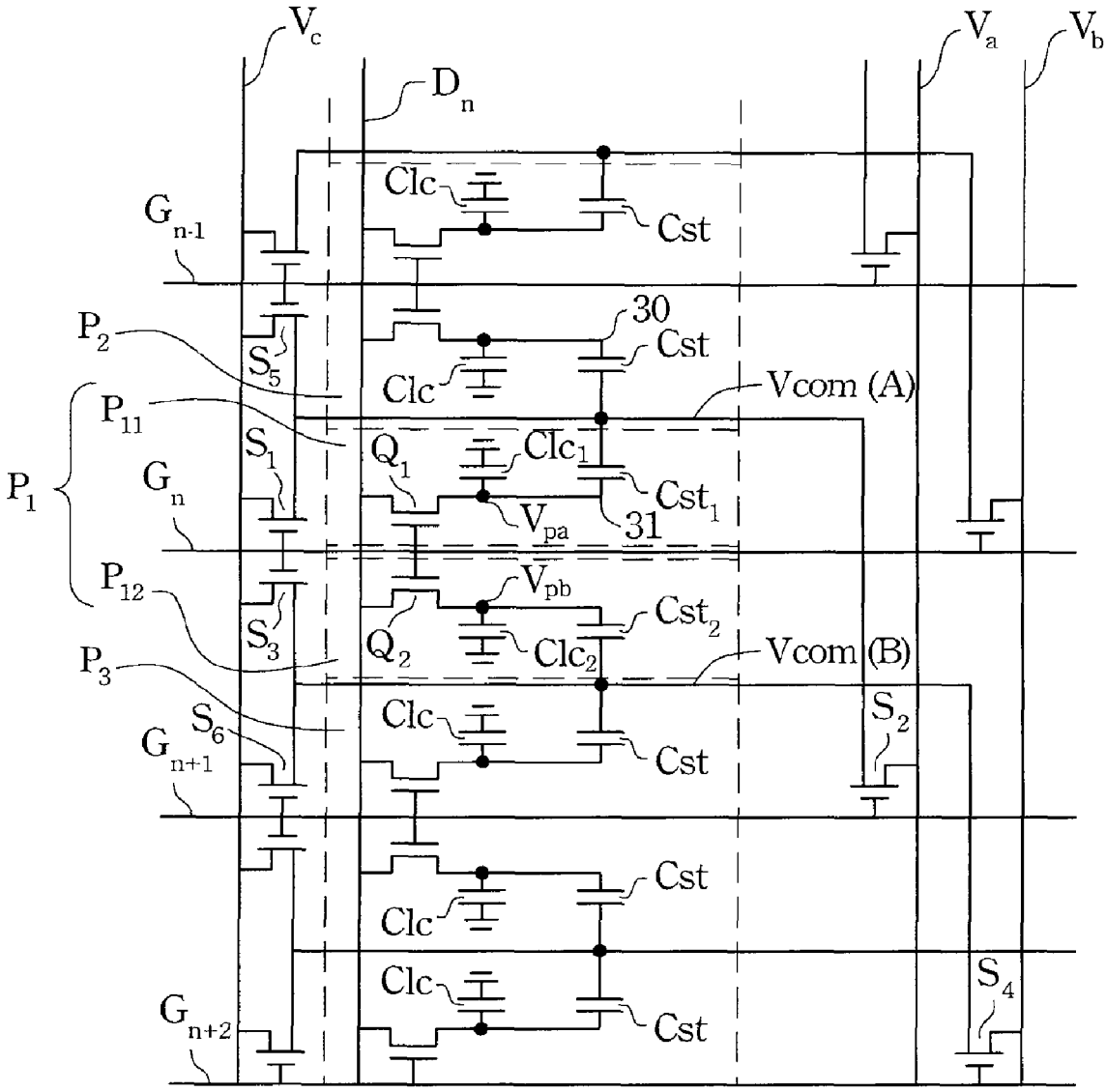
FIG. 7A illustrates an enlarged schematic diagram of a pixel unit according to the eighth embodiment of the present invention.

FIG. 7A illustrates a top view of a liquid crystal display according to the eighth embodiment of the present invention. In this embodiment, adjacent pixel units have same common electrode line. For example, the pixel unit P1 and the pixel unit P2 have a same common electrode line $V_{com}$ (A). The pixel unit P2 and the pixel unit P3 have a same common electrode line $V_{com}$ (B).

As described in the foregoing paragraphs, a pixel unit P1 is defined by adjacent data lines and adjacent scan lines. Two common electrode lines $V_{com}$ (A) and $V_{com}$ (B) parallel to the scan lines are arranged in the pixel unit. According to this embodiment of the present invention, the pixel unit P1 is divided into two sub-pixels P11 and P12. Each sub pixel P11 or P12 includes a storage capacitor $C_{st}$ that is composed of the pixel electrode and the common electrode. The storage capacitors located in different sub pixels P11 and P12 are connected to different common electrodes. The voltages applied to the common electrodes are tuned to change the voltage in the pixel electrodes in the sub pixels P11 and P12 respectively.

In this embodiment, the common electrode line $V_{com}$ (A) is connected to the voltage source Vc through two switch devices S1 and S5 and is connected to the voltage source Va through switch device S2. The scan lines Gn−1, Gn and Gn+1 respectively control the switch of the switch devices S5, S1 and S2. The common electrode line $V_{com}$ (B) is connected to the voltage source Vc through two switch devices S3 and S6 and is connected to the voltage source Vb through switch device S4. The scan lines Gn, Gn+1 and Gn+2 respectively control the switch of the switch devices S3, S6 and S4. The scan lines are sequentially driven to respectively turn on the switch devices S1, S3, the switch devices S2, S6 and the switch device S4 to change the voltage source connected to the common electrode line $V_{com}$ (A) and the common electrode line $V_{com}$ (B). By the coupling effect of the storage capacitors $C_{st1}$ and $C_{st2}$, different voltages are applied to the pixel electrodes 30 and 31 to make the two sub-pixels P11 and P12 have different pixel voltage The sub-pixel P11 includes a transistor $Q_1$. According to the transistor $Q_1$, the gate electrode is connected to the scan line Gn, the first source/drain electrode is connected to the data line Dn and the second source/drain electrode is connected to the pixel electrode 30. The storage capacitor $C_{st1}$ is composed of the pixel electrode 30 and the common electrode $V_{com}$ (A). The liquid crystal capacitor $C_{LC1}$ is composed of the pixel electrode 30 and the conductive electrode in the upper substrate (not shown in figure).

The sub-pixel P12 also includes a transistor $Q_2$. According to the transistor $Q_2$, the gate electrode is connected to the scan line Gn, the first source/drain electrode is connected to the data line Dn and the second source/drain electrode is connected to the pixel electrode 31. The storage capacitor $C_{st2}$ is composed of the pixel electrode 31 and the common electrode $V_{com}$ (B). The liquid crystal capacitor $C_{LC2}$ is composed of the pixel electrode 31 and the conductive electrode in the upper substrate (not shown in figure). When a scan voltage is applied to the scan line Gn, the transistors $Q_1$ and $Q_2$ are turned on. The data voltage in the data line Dn is transferred to the pixel electrode 30 and the pixel electrode 31 and is written into the corresponding storage capacitor $C_{st1}$, the storage capacitor $C_{st2}$, the liquid crystal capacitor $C_{LC1}$ and the liquid crystal capacitor $C_{LC2}$.

Figure 7B:
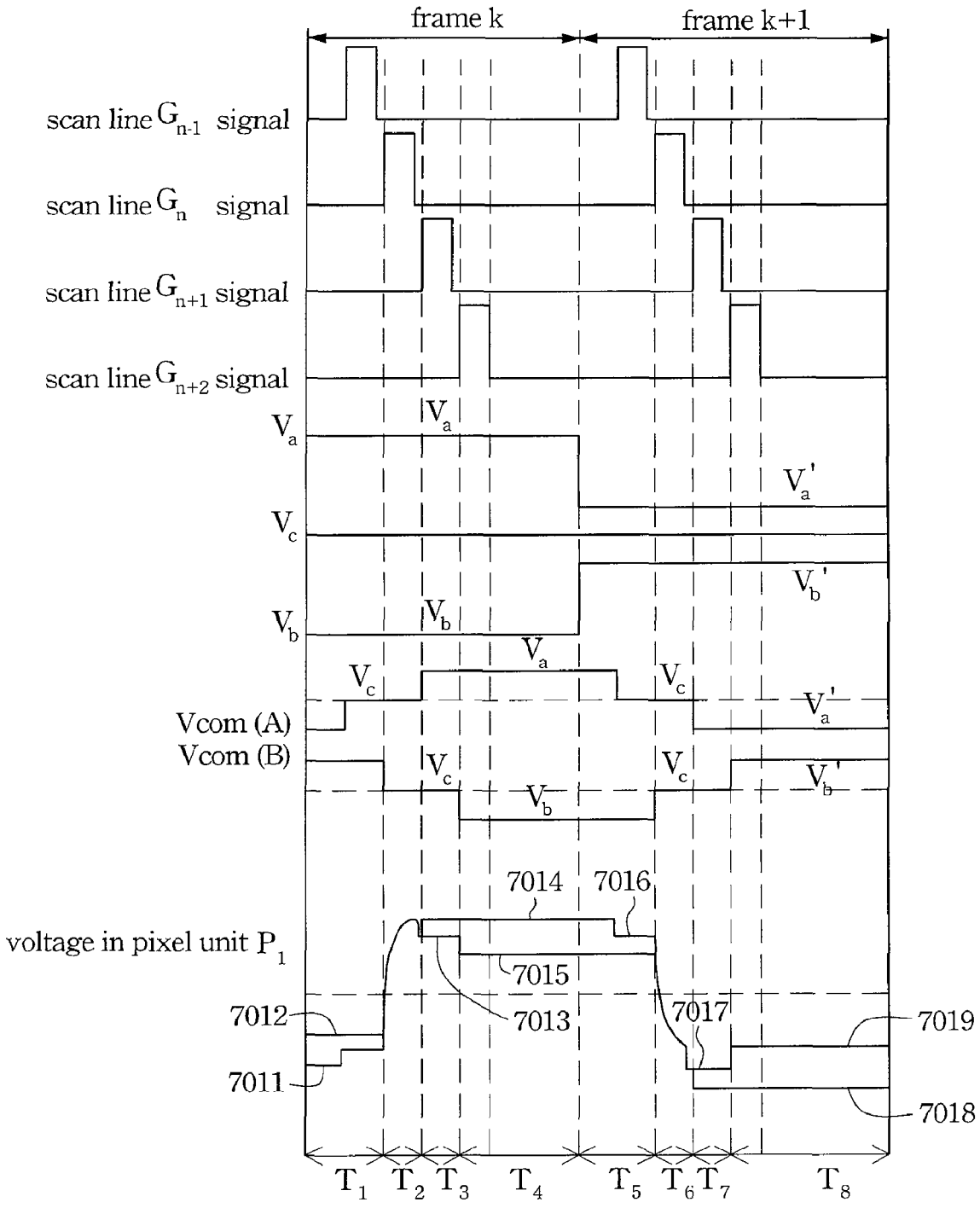
FIG. 7B illustrates drive waveforms for the common electrodes according to the eighth embodiment of the present invention.

FIG. 7B illustrates a drive waveform for driving a liquid crystal display according to the eighth embodiment of the present invention. With reference to FIGS. 7A and 7B, during the time segment $t_1$ in frame K, the scan line Gn−1 is in a high voltage state. Therefore, the switch device S5 is turned on and the switch devices S3 and S6 are turned off. The common electrode line $V_{com}$ (A) is connected to the voltage source Vc. Therefore, a voltage Vc is applied to the common electrode line $V_{com}$ (A). The common electrode line $V_{com}$ (B) has the same voltage state as the previous time segment. The transistors $Q_1$ and $Q_2$ are turned off. Therefore, the voltage states in the liquid crystal capacitors $C_{LC1}$ and $C_{LC1}$ and the voltage states in the storage capacitors $C_{st1}$ and $C_{st2}$ are same as that in the previous time segment. In this case, the pixel electrode 30 in the sub-pixel P11 has the pixel voltage 7011 and the pixel electrode 31 in the sub-pixel P12 has the pixel voltage 7012.

During the time segment $t_2$ in frame K, the scan line Gn is in a high voltage state. Therefore, the transistors $Q_1$ and $Q_2$ and the switch device S1 and S3 are turned on. Both the common electrode line $V_{com}$ (A) and the common electrode line $V_{com}$ (B) are connected to the voltage source Vc through the switch device S1 and S3 respectively. Therefore, a voltage Vc is applied to the common electrode line $V_{com}$ (A) and the common electrode line $V_{com}$ (B). The voltage in the data line Dn may charge the liquid crystal capacitors $C_{LC1}$ and $C_{LC1}$ and the storage capacitors $C_{st1}$ and $C_{st2}$ through the transistors $Q_1$ and $Q_2$. At this time, the pixel electrode 30 and the pixel electrode 31 in the sub-pixel P11 and P12 have the pixel voltage 7013 in the data line Dn.

During the time segment $t_3$ in frame K, the scan line Gn+1 is scanned. Therefore, the scan line Gn+1 is in a high voltage state and the scan line Gn is in a low voltage state. The transistors $Q_1$ and $Q_2$ are turned off and the switch devices S6 and S2 are turned on. The common electrode line $V_{com}$ (B) is connected to the voltage source Vc through the switch device S6. Therefore, a voltage Vc is applied to the common electrode line $V_{com}$ (B). The common electrode line $V_{com}$ (A) is connected to the voltage source Va through the switch device S2. Therefore, a voltage Va is applied to the common electrode line $V_{com}$ (A). At the start of time segment $t_3$, the pixel electrode 30 and the pixel electrode 31 have the pixel voltage 7013 in the data line $D_n$. However, at the start of the time segment $t_3$, the voltage applied to the common electrode $V_{com}$ (A) in the sub-pixel P11 changes from Vc to Va. Such a voltage change may change the voltage in the pixel electrode 30 from voltage 7013 up to the voltage 7014 through the coupling effect of the storage capacitor $C_{st1}$. On the other hand, the voltage applied to the common electrode $V_{com}$ (B) keeps the same. Therefore, the voltage in the pixel electrode 31 is the voltage 7013.

During the time segment $t_4$ in frame K, the scan line Gn+2 is scanned. Therefore, the scan line Gn+2 is in a high voltage state and the scan lines Gn and Gn−1 are in a low voltage state. The transistors $Q_1$ and $Q_2$ and the switch devices S1, S5 and S2 are turned off and the switch device S4 is turned on. The common electrode line $V_{com}$ (B) is connected to the voltage source Vb through the switch device S4. Therefore, a voltage Vb is applied to the common electrode line $V_{com}$ (B). The common electrode line $V_{com}$ (A) keeps the voltage Va. At the start of time segment $t_3$, the pixel electrode 30 has the pixel voltage 7014 and the pixel electrode 31 has the pixel voltage 7013. However, at the start of the time segment $t_3$, the voltage applied to the common electrode $V_{com}$ (B) in the sub-pixel P11 changes from Vc to Vb. Such a voltage change may change the voltage in the pixel electrode 31 from voltage 7013 down to the voltage 7015 through the coupling effect of the storage capacitor $C_{st2}$.

Next, during the time segment $t_5$ in frame K+1, the scan lines are scanned again and the voltage supplied by the voltage source Va and Vb is transformed. The scan line Gn−1 is scanned. Therefore, the scan line Gn−1 is in a high voltage state. Therefore, the transistors $Q_1$ and $Q_2$ and the switch devices S3 and S6 are turned off and the switch device S5 is turned on. The common electrode line $V_{com}$ (A) is connected to the voltage source Vc. Therefore, a voltage Vc is applied to the common electrode line $V_{com}$ (A). The common electrode line $V_{com}$ (B) has the same voltage state as the previous time segment. At the start of time segment $t_5$, the pixel electrode 30 has the pixel voltage 7014 and the pixel electrode 31 has the pixel voltage 7015. However, at the start of the time segment $t_5$, the voltage applied to the common electrode $V_{com}$ (A) changes from Va to Vc. Such a voltage change may change the voltage in the pixel electrode 30 from voltage 7014 down to the voltage 7016 through the coupling effect of the storage capacitor $C_{st1}$.

During the time segment $t_6$ in frame K+1, the scan line Gn is scanned. Therefore, the scan line Gn is in a high voltage state. Therefore, the transistors $Q_1$ and $Q_2$ and the switch devices S1 and S3 are turned on. Both the common electrode line $V_{com}$ (A) and the common electrode line $V_{com}$ (B) are connected to the voltage source Vc. Therefore, a voltage Vc is applied to the common electrode line $V_{com}$ (A) and common electrode line $V_{com}$ (B). The voltage in the data line $D_n$ may charge the liquid crystal capacitors $C_{LC1}$ and $C_{LC2}$ and the storage capacitors $C_{st1}$ and $C_{st2}$ through the transistors $Q_1$ and $Q_2$. The data transferred in the Data line is reversed from frame K to frame K+1. Therefore, the pixel electrode 30 and the pixel electrode 31 in the sub-pixel P11 and P12 have the pixel voltage 7017.

During the time segment $t_7$ in frame K+1, the scan line Gn+1 is scanned. Therefore, the scan line Gn+1 is in a high voltage state and the scan line Gn is in a low voltage state. The transistors $Q_1$ and $Q_2$ are turned off and the switch device S2 and S6 are turned on. The common electrode line $V_{com}$ (A) is connected to the voltage source Va through the switch device S2. Therefore, a transformed voltage Va' is applied to the common electrode line $V_{com}$ (A). The common electrode line $V_{com}$ (B) is connected to the voltage source Vc through the switch device S6. Therefore, a transformed voltage Vc is applied to the common electrode line $V_{com}$ (B). At the start of time segment $t_7$, the pixel electrode 30 and the pixel electrode 31 have the pixel voltage 7017 in the data line Dn. However, at the start of the time segment t7, the voltage applied to the common electrode $V_{com}$ (A) changes from Vc to Va'. Such a voltage change may change the voltage in the pixel electrode 30 from voltage 7017 down to the voltage 7018 through the coupling effect of the storage capacitor $C_{st1}$. On the other hand, the voltage applied to the common electrode $V_{com}$ (B) keeps the same. Therefore, the voltage in the pixel electrode 31 does not be changed. Therefore, the pixel electrode 30 and the pixel electrode 31 in the sub-pixel P11 and P12 have different voltages.

During the time segment $t_8$ in frame K+1, the scan line Gn+2 is scanned. Therefore, the scan line Gn+2 is in a high voltage state. The transistors $Q_1$ and $Q_2$ and the switch device S1, S5 and S2 are turned off and the switch device S4 is turned on. The common electrode line $V_{com}$ (B) is connected to the voltage source Vb through the switch device S4. Therefore, a transformed voltage Vb' is applied to the common electrode line $V_{com}$ (B). The voltage applied to the common electrode line $V_{com}$ (A) does not be changed. Therefore, a transformed voltage Va' is applied to the common electrode line $V_{com}$ (A). At the start of time segment $t_8$, the pixel electrode 30 has the pixel voltage 70178 and the pixel electrode 31 has the pixel voltage 7017. However, at the start of the time segment t8, the voltage applied to the common electrode $V_{com}$ (B) changes from Vc to Vb'. Such a voltage change may change the voltage in the pixel electrode 31 from voltage 7017 up to the voltage 7019 through the coupling effect of the storage capacitor $C_{st2}$. Therefore, the pixel electrode 30 and the pixel electrode 31 in the sub-pixel P11 and P12 have different voltages.

Figure 7C:
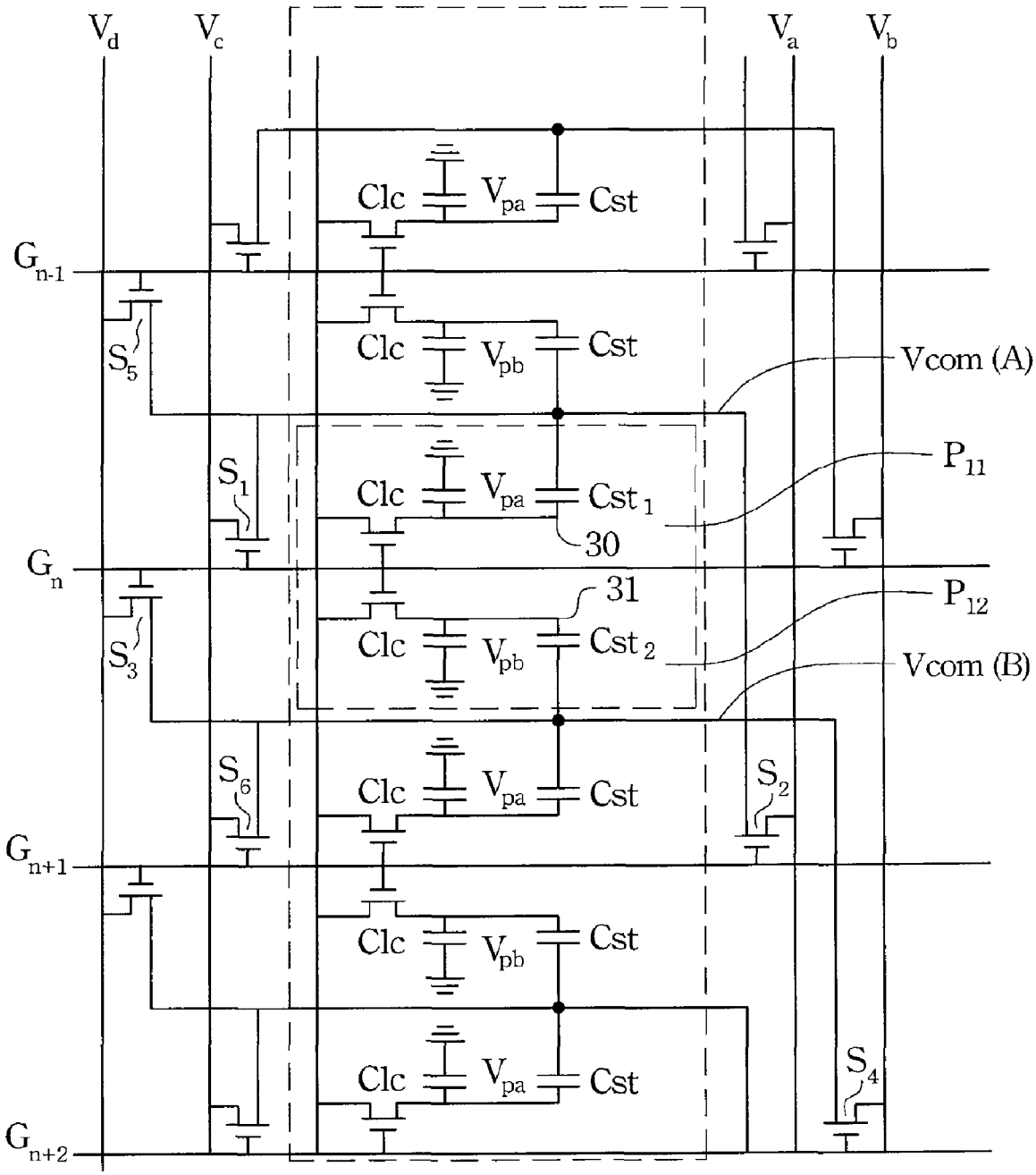
FIG. 7C illustrates an enlarged schematic diagram of a pixel unit according to the ninth embodiment of the present invention.

FIG. 7C illustrates a top view of a pixel unit according to the ninth embodiment of the present invention. In this embodiment, the common electrode line $V_{com}$ (A) and the common electrode line $V_{com}$ (B) are driven by three voltage sources respectively. The common electrode line $V_{com}$ (A) is connected to the voltage source Vd through the switch device S5, is connected to the voltage source Vc through the switch device S1 and is connected to the voltage source Va through the switch device S2. The scan line Gn−1, Gn and Gn+1 respectively control the switch of the switch devices S5, S1 and. The common electrode line $V_{com}$ (B) is connected to the voltage source Vd through the switch device S3, is connected to the voltage source Vc through the switch device S6 and is connected to the voltage source Vb through the switch device S4. The scan line Gn, Gn+1 and Gn+2 respectively control the switch of the switch devices S3, S6 and S4. According to this embodiment, the scan lines are sequentially driven to respectively turn on the switch devices S5, the switch devices S1, S3, the switch devices S2, S6 and the switch device S4 to change the voltage source connected to the common electrode line $V_{com}$ (A) and the common electrode line $V_{com}$ (B). By the coupling effect of the storage capacitors $C_{st1}$ and $C_{st2}$, different voltages are applied to the pixel electrodes 30 and 31 to make the two sub-pixels P11 and P12 have different pixel voltages.

Figure 7D:
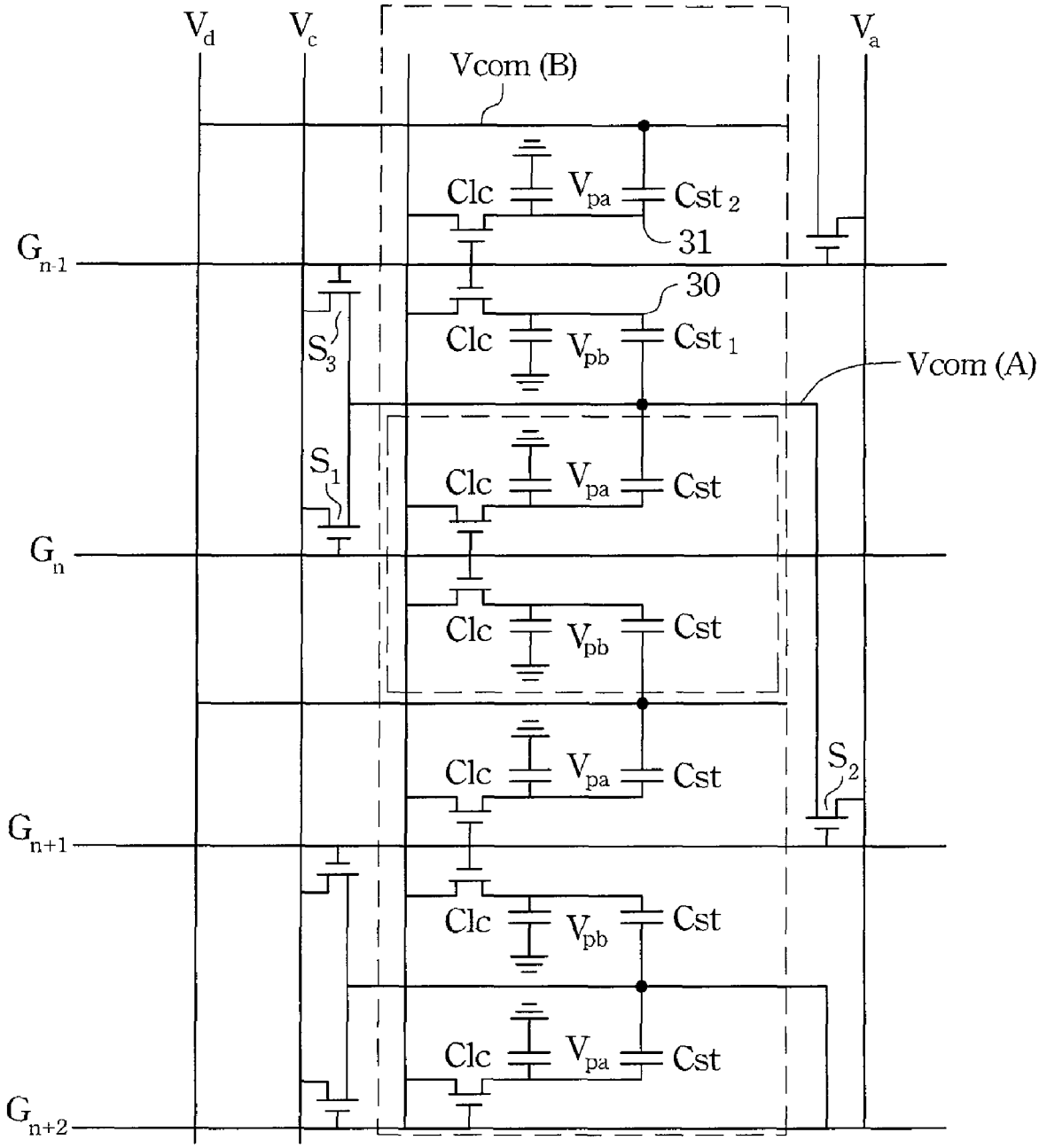
FIG. 7D illustrates an enlarged schematic diagram of a pixel unit according to the tenth embodiment of the present invention.

FIG. 7D illustrates a top view of a pixel unit according to the tenth embodiment of the present invention. In this embodiment, the common electrode line $V_{com}$ (B) is connected to the voltage source Vb. The common electrode line $V_{com}$ (A) is connected to the voltage source Vc through the switch devices S1 and S3 and is connected to the voltage source Va through the switch device S2. The scan lines Gn−1, Gn and Gn+1 respectively control the switch of the switch devices S3, S1 and S2. The scan lines Gn−1, Gn and Gn+1 are sequentially driven to switch the switch devices S3, S1 and S2 to change the voltage source coupling with the common electrode line $V_{com}$ (A). By the coupling effect of the storage capacitors $C_{st1}$ and $C_{st2}$, different voltages are applied to the pixel electrodes 30 and 31 to make the two sub-pixels P11 and P12 have different pixel voltages.

Figure 7E:
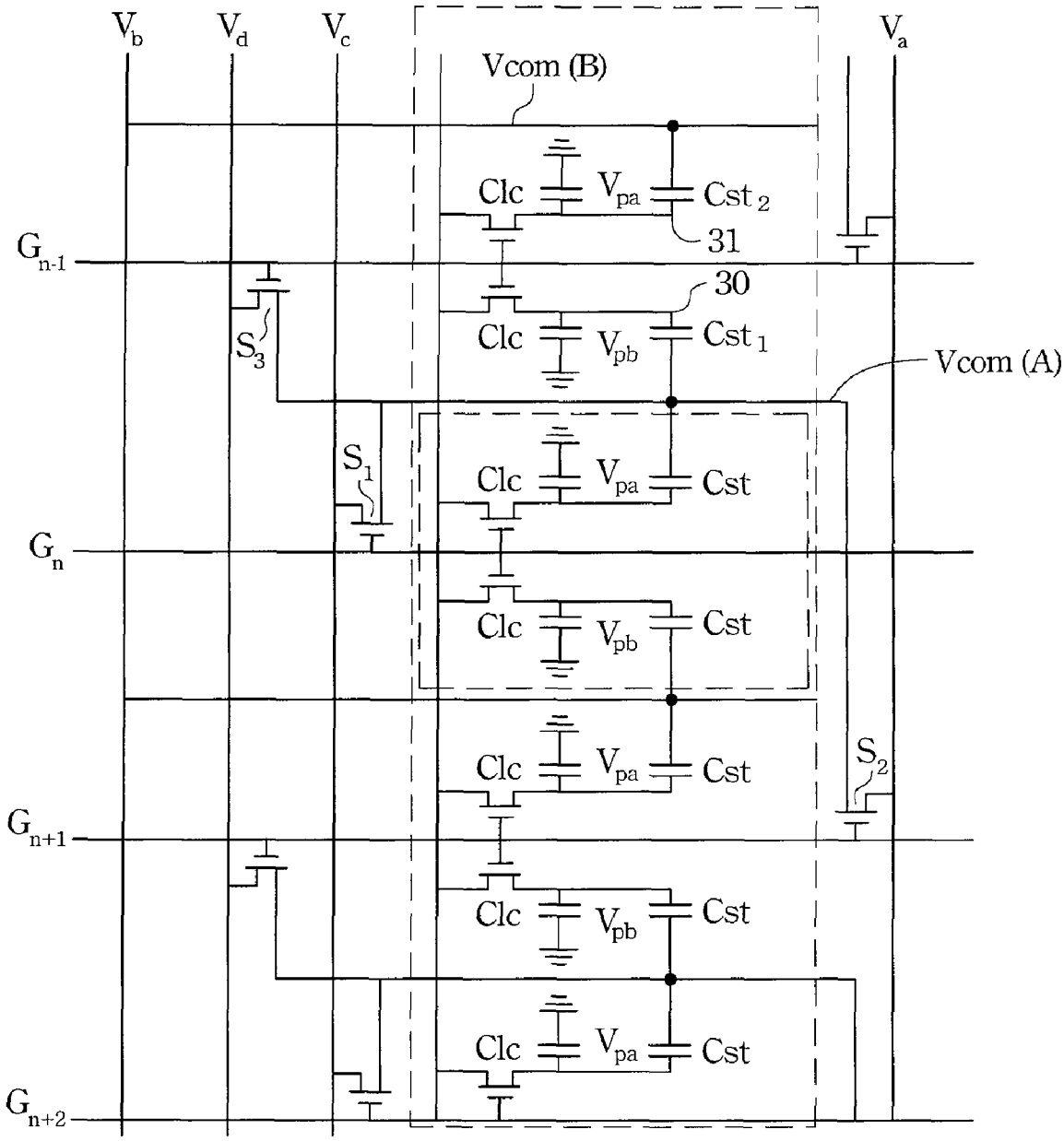
FIG. 7E illustrates an enlarged schematic diagram of a pixel unit according to the eleventh embodiment of the present invention.
Figure 8:
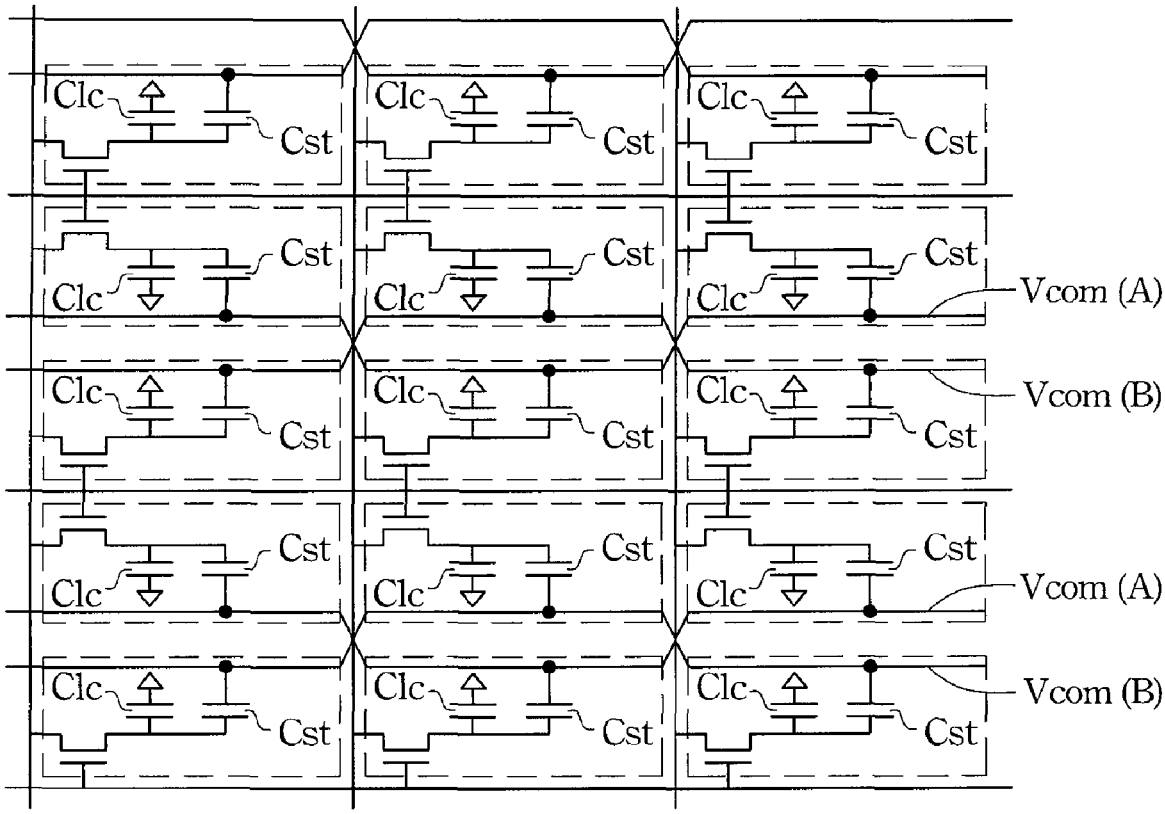
FIG. 8 illustrates a schematic diagram of a liquid crystal display according to an embodiment of the present invention.

FIG. 7E illustrates a top view of a pixel unit according to the eleventh embodiment of the present invention. In this embodiment, the common electrode line $V_{com}$ (A) is driven by three voltage sources. The common electrode line $V_{com}$ (B) is connected to the voltage source Vb. The common electrode line $V_{com}$ (A) is connected to the voltage source Vd through the switch device S3, connected to the voltage source Vc through the switch device S1 and connected to the voltage source Va through the switch device S2. The scan lines Gn−1, Gn and Gn+1 control the switch of the switch devices S3, S1 and S2. The scan lines Gn−1, Gn and Gn+1 are sequentially driven to switch the switch devices S3, S1 and S2 to change the voltage source coupling with the common electrode line $V_{com}$ (A). By the coupling effect of the storage capacitors $C_{st1}$ and $C_{st2}$, different voltages are applied to the pixel electrodes 30 and 31 to make the two sub-pixels P11 and P12 have different pixel voltages.

The common electrode lines in the foregoing embodiments are designed to parallel to the scan lines. Therefore, the pixel units driven by the same common electrode lines are arranged adjacently. However, in other embodiments, the common electrode line $V_{com}$ (A) and the common electrode line $V_{com}$ (B) may be arranged in a zigzag pattern over the substrate. Accordingly, the pixel units arranged alternately may be driven by same common electrode line to reach a uniform display.

Accordingly, a pixel unit in the present invention is divided into two sub-pixels. Each sub-pixel includes a thin film transistor, a liquid crystal capacitor and a storage capacitor. The storage capacitors in the two sub-pixels are connected to different common electrode lines respectively. The common electrode lines are connected to different voltage sources through switch devices respectively. The switch devices are driven by different scan lines. The scan lines are sequentially driven to switch the switch devices to change the voltage source coupling with the common electrode lines. By the coupling effect of the storage capacitors, different voltages are applied to the pixel electrodes to make the two sub-pixels have different pixel voltages. Different voltages exist in the two pixel electrodes to compensate to each other to release the color shift phenomenon.

As is understood by a person skilled in the art, the foregoing descriptions of the preferred embodiment of the present invention are an illustration of the present invention rather than a limitation thereof. Various modifications and similar arrangements are included within the spirit and scope of the appended claims. The scope of the claims should be accorded to the broadest interpretation so as to encompass all such modifications and similar structures. While a preferred embodiment of the invention has been illustrated and described, it will be appreciated that various changes can be made therein without departing from the spirit and scope of the invention.

What is claimed is:

1. A liquid crystal display, comprising:

a plurality of data lines;

a plurality of scan lines crossing the data lines;

a plurality of first and second common electrode lines alternately arranged with the scan lines, wherein two neighboring gate lines and two neighboring data lines define a pixel unit;

a first switch device and a second switch device connected to different scan lines; and a plurality of voltage sources, wherein the first common electrode lines are connected to one of the voltage sources, and the second common electrode lines are connected to two of the voltage sources through the first switch device and the second switch device.

2. The liquid crystal display of claim 1, wherein the voltage sources includes a first voltage source and a second voltage source, wherein the first common electrode lines are connected to the first voltage source, and the second common electrode lines are connected to the first voltage source through the first switch device and connected to the second voltage source through the second switch device, wherein the first voltage source provides a fixed voltage value and the second voltage source provides a changeable voltage value and is changed between adjacent frames.

3. The liquid crystal display of claim 2, wherein the changeable voltage value is changed to a different voltage levels.

4. The liquid crystal display of claim 1, wherein the voltage sources includes a first voltage source, a second voltage source and a third voltage source, wherein the first common electrode lines are connected to the third voltage source, and the second common electrode lines are connected to the first voltage source through the first switch device and connected to the second voltage source through the second switch device.

5. The liquid crystal display of claim 1, wherein the first voltage has a fixed voltage value, the second voltage has a changeable voltage value and is changed between adjacent frames and the third voltage has an oscillating voltage value.

6. The liquid crystal display of claim 5, wherein the second voltage is changed to a different voltage levels.

7. The liquid crystal display of claim 1, further comprising a third switch device and a fourth switch device, wherein the first common electrode lines are connected to two of the voltage sources through the third switch device and the fourth switch device, and different scan lines control the third switch device and the fourth switch.

8. The liquid crystal display of claim 7, wherein the first switch device and the third switch device are connected to same scan line, and the second switch device and the fourth switch device are connected to same scan line.

9. The liquid crystal display of claim 7, wherein the first switch device and the third switch device are connected to same scan line, and the second switch device and the fourth switch device are connected to different scan lines.

10. The liquid crystal display of claim 7, wherein the voltage sources includes a first voltage source, a second voltage source and a third voltage source, wherein the first common electrode lines are connected to the third voltage source through the third switch device and connected to the first voltage source through the fourth switch device, and the second common electrode lines are connected to the third voltage source through the first switch device and connected to the second voltage source through the second switch device.

11. The liquid crystal display of claim 7, wherein the voltage sources includes a first voltage source, a second voltage source, a third voltage source and a fourth voltage source, wherein the first common electrode lines are connected to the third voltage source through the third switch device and connected to the first voltage source through the fourth switch device, and the second common electrode lines are connected to the third voltage source through the first switch device and connected to the fourth voltage source through the second switch device.

12. The liquid crystal display of claim 11, wherein the first voltage source and the second voltage source provide changeable voltage values that are changed between adjacent frames and the third voltage source provides a fixed voltage value.

13. A liquid crystal display, comprising:

a plurality of data lines;

a plurality of scan lines crossing the data lines;

a plurality of first and second common electrode lines alternately arranged with the scan lines, wherein two neighboring gate lines and two neighboring data lines define a pixel unit;

a first switch device, a second switch device and a third switch device connected to different scan lines; and a plurality of voltage sources, wherein the first common electrode lines are connected to one of the voltage sources, and the second common electrode lines are connected to two of the voltage sources through the first switch device, the second switch device and the third switch device.

14. The liquid crystal display of claim 13, wherein the voltage sources includes a first voltage source, a second voltage source and a third voltage source, wherein the first common electrode lines are connected to the first voltage source, and the second common electrode lines are connected to the second voltage source through the second switch device and connected to the third voltage source through the third switch device.

15. The liquid crystal display of claim 14, wherein the first voltage source provides a first voltage, the second voltage source provides a second voltage and the third voltage source provides a third voltage, wherein the first voltage has a fixed voltage value and the third voltage has a changeable voltage value and is changed between adjacent frames.

16. The liquid crystal display of claim 15, wherein the second voltage has a changeable voltage value and is changed between adjacent frames.

17. The liquid crystal display of claim 15, wherein the second voltage has a fixed voltage value.

18. The liquid crystal display of claim 13, further comprising a fourth switch device, a fifth switch device and a sixth switch device, wherein the first common electrode lines are connected to two of the voltage sources through the fourth switch device, the fifth switch device and the sixth switch device.

19. The liquid crystal display of claim 18, wherein the voltage sources includes a first voltage source, a second voltage source and a third voltage source, wherein the first common electrode lines are connected to the first voltage source through the fourth switch device and the fifth switch device and connected to the second voltage source through the sixth switch device, and the second common electrode lines are connected to the first voltage source through the first switch device and the second switch device and connected to the third voltage source through the third switch device.

20. The liquid crystal display of claim 13, further comprising a fourth switch device, a fifth switch device and a sixth switch device, wherein the first common electrode lines are connected to three of the voltage sources through the fourth switch device, the fifth switch device and the sixth switch device.

21. The liquid crystal display of claim 13, wherein the voltage sources includes a first voltage source, a second voltage source, a third voltage source and a fourth voltage source, wherein the first common electrode lines are connected to the first voltage source, and the second common electrode lines are connected to the second voltage source through the first switch device, connected to the third voltage source through the second switch device and connected to the fourth voltage source through the third switch device.

22. The liquid crystal display of claim 21, wherein the first voltage source provides a first voltage, the second voltage source provides a second voltage, the third voltage source provides a third voltage and the fourth voltage source provides a fourth voltage, wherein the first voltage has a fixed voltage value and the third voltage has a changeable voltage value and is changed between adjacent frames.

23. The liquid crystal display of claim 22, wherein the fourth voltage has a fixed voltage value and the third voltage has a changeable voltage value and is changed between adjacent frames, wherein the third voltage is changed to a same voltage level or is changed to different voltage levels.

24. The liquid crystal display of claim 22, wherein the fourth voltage is changed to a same voltage level or is changed to different voltage levels between adjacent frames.

25. The liquid crystal display of claim 13, wherein the first common electrode lines and the second common electrode lines are arranged in a zigzag pattern.

* * * * *